US009149088B2

(12) United States Patent
Minami

(10) Patent No.: US 9,149,088 B2
(45) Date of Patent: Oct. 6, 2015

(54) MEDIAL ROTATIONAL TRACTION ELEMENT ARRANGEMENT FOR AN ARTICLE OF FOOTWEAR

(75) Inventor: Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 76 days.

(21) Appl. No.: 13/234,168

(22) Filed: Sep. 16, 2011

(65) Prior Publication Data

US 2013/0067777 A1 Mar. 21, 2013

(51) Int. Cl.

| | |
|---|---|
| ***A43C 15/00*** | (2006.01) |
| ***A43B 13/22*** | (2006.01) |
| ***A43B 13/26*** | (2006.01) |
| ***A43C 15/16*** | (2006.01) |

(52) U.S. Cl.

CPC ..... *A43B 13/223* (2013.01); *A43B 13/22* (2013.01); *A43B 13/26* (2013.01); *A43C 15/16* (2013.01); *A43C 15/162* (2013.01)

(58) Field of Classification Search

CPC ..... A43B 5/02; A43B 13/223; A43C 15/161; A43C 15/16; A43C 15/162; A43C 15/164; A43C 15/165; A43C 15/167; A43C 15/168

USPC ..... 36/59, 59 R, 103, 59 C, 126–129, 36/67 A–67 D, 67 R, 134

See application file for complete search history.

(56) References Cited

U.S. PATENT DOCUMENTS

| | | | | |
|---|---|---|---|---|
| 365,245 | A | | 6/1887 | De Graff |
| D171,130 | S | | 12/1953 | Gruner |
| 2,677,905 | A | | 5/1954 | Dye |
| 3,127,687 | A | * | 4/1964 | Hollister et al. ..... 36/114 |
| 3,354,561 | A | | 11/1967 | Cameron |
| 3,413,737 | A | | 12/1968 | Kneebusch |
| 3,529,370 | A | | 9/1970 | Bernier et al. |
| 3,583,082 | A | | 6/1971 | Jordan |
| 3,656,245 | A | | 4/1972 | Wilson |
| 3,739,497 | A | | 6/1973 | Cameron |

(Continued)

FOREIGN PATENT DOCUMENTS

| | | |
|---|---|---|
| CN | 1285174 | 2/2001 |
| CN | 1285174 A | 2/2001 |

(Continued)

OTHER PUBLICATIONS

International Search Report and Written Opinion mailed Jan. 25, 2013 in International Application No. PCT/US2012/052605.

(Continued)

*Primary Examiner* — Khoa Huynh
*Assistant Examiner* — Megan Brandon
(74) *Attorney, Agent, or Firm* — Plumsea Law Group, LLC

(57) ABSTRACT

A traction element arrangement for a sole structure of an article of footwear is described. Traction elements of a first group are associated with a lateral side of the sole structure. Traction elements of a second group are associated with a medial side of the sole structure. Traction elements of the second group include medial rotational traction elements that have a plurality of stud elements arranged in a circular grouping. Stud elements may be aligned laterally across the sole structure with traction elements of the first group. Stud elements may be aligned longitudinally across the sole structure to be arranged in different configurations along an outside medial side or an inside medial side.

26 Claims, 18 Drawing Sheets

(56) References Cited

U.S. PATENT DOCUMENTS

| | | | | |
|---|---|---|---|---|
| 3,757,437 | A | 9/1973 | Cameron | |
| 3,816,945 | A | 6/1974 | Egtvedt | |
| 3,846,921 | A | 11/1974 | Kobayashi | |
| 4,010,559 | A * | 3/1977 | Mitchell | 36/128 |
| 4,098,011 | A | 7/1978 | Bowerman et al. | |
| 4,233,759 | A | 11/1980 | Bente et al. | |
| 4,241,524 | A | 12/1980 | Sink | |
| 4,347,674 | A | 9/1982 | George | |
| 4,392,312 | A * | 7/1983 | Crowley et al. | 36/67 R |
| 4,393,604 | A | 7/1983 | Crowley | |
| 4,430,810 | A | 2/1984 | Bente | |
| 4,472,098 | A | 9/1984 | Kiefer | |
| 4,586,274 | A | 5/1986 | Blair | |
| D288,028 | S | 2/1987 | Chassaing | |
| D290,781 | S | 7/1987 | Grubel | |
| 4,689,901 | A | 9/1987 | Ihlenburg | |
| D294,655 | S | 3/1988 | Heyes | |
| D295,231 | S | 4/1988 | Heyes | |
| 4,885,851 | A | 12/1989 | Peterson | |
| D318,170 | S | 7/1991 | Hatfield | |
| 5,201,126 | A * | 4/1993 | Tanel | 36/134 |
| D342,151 | S | 12/1993 | Saito et al. | |
| 5,335,429 | A | 8/1994 | Hansen | |
| D350,642 | S | 9/1994 | Novy | |
| 5,461,801 | A * | 10/1995 | Anderton | 36/114 |
| 5,483,760 | A | 1/1996 | Kataoka et al. | |
| 5,533,282 | A | 7/1996 | Kataoka et al. | |
| 5,581,913 | A | 12/1996 | Kataoka et al. | |
| 5,628,129 | A | 5/1997 | Kilgore et al. | |
| 5,689,904 | A | 11/1997 | Kataoka et al. | |
| D387,892 | S * | 12/1997 | Briant | D2/962 |
| D389,294 | S | 1/1998 | Fogg | |
| D390,692 | S | 2/1998 | Dietrich | |
| 5,724,754 | A | 3/1998 | Kataoka et al. | |
| D396,139 | S | 7/1998 | Dietrich | |
| D397,850 | S * | 9/1998 | Harada et al. | D2/959 |
| D402,800 | S | 12/1998 | Santos et al. | |
| D405,249 | S | 2/1999 | Hikita et al. | |
| D409,362 | S | 5/1999 | Turner et al. | |
| 5,901,472 | A | 5/1999 | Adam | |
| 5,964,048 | A * | 10/1999 | Shieh | 36/134 |
| 5,979,083 | A | 11/1999 | Robinson et al. | |
| 5,992,059 | A | 11/1999 | Bettenga et al. | |
| 6,006,454 | A | 12/1999 | Sitzler, Sr. | |
| 6,016,613 | A * | 1/2000 | Campbell et al. | 36/59 C |
| 6,018,893 | A | 2/2000 | Workman | |
| 6,032,388 | A | 3/2000 | Fram | |
| 6,035,559 | A | 3/2000 | Freed et al. | |
| 6,041,526 | A | 3/2000 | Collins | |
| 6,101,746 | A | 8/2000 | Evans | |
| D432,767 | S | 10/2000 | Fogg | |
| D450,433 | S | 11/2001 | Savoie | |
| D450,435 | S | 11/2001 | Savoie | |
| D454,681 | S * | 3/2002 | Duval | D2/962 |
| 6,357,146 | B1 | 3/2002 | Wordsworth et al. | |
| D455,543 | S | 4/2002 | Feeney et al. | |
| 6,467,196 | B1 | 10/2002 | Koyama | |
| D476,142 | S | 6/2003 | Matis | |
| 6,647,647 | B2 | 11/2003 | Auger et al. | |
| 6,705,027 | B1 | 3/2004 | Campbell | |
| D493,277 | S | 7/2004 | Gan | |
| 6,793,996 | B1 * | 9/2004 | Umezawa | 428/36.8 |
| 6,892,479 | B2 | 5/2005 | Auger et al. | |
| 6,973,745 | B2 * | 12/2005 | Mills et al. | 36/116 |
| 7,007,410 | B2 | 3/2006 | Auger et al. | |
| D525,416 | S | 7/2006 | Auger et al. | |
| D532,960 | S * | 12/2006 | Pellerin | D2/962 |
| D547,037 | S | 7/2007 | Nakano | |
| D552,336 | S | 10/2007 | Parekh et al. | |
| 7,287,343 | B2 | 10/2007 | Healy | |
| D556,985 | S | 12/2007 | Schoenborn et al. | |
| 7,406,781 | B2 | 8/2008 | Scholz | |
| D577,480 | S * | 9/2008 | Ortley et al. | D2/962 |
| 7,430,819 | B2 | 10/2008 | Auger et al. | |
| D580,144 | S | 11/2008 | Lussier | |
| D595,941 | S | 7/2009 | Byrne | |
| 7,559,160 | B2 | 7/2009 | Kelly | |
| D605,838 | S | 12/2009 | Foust | |
| 7,673,400 | B2 | 3/2010 | Brown et al. | |
| 7,685,745 | B2 | 3/2010 | Kuhtz et al. | |
| D617,542 | S * | 6/2010 | Stauffer | D2/962 |
| 7,730,637 | B2 | 6/2010 | Scholz | |
| D618,895 | S | 7/2010 | Wolff | |
| 7,757,413 | B2 | 7/2010 | Anderson | |
| 7,762,009 | B2 | 7/2010 | Gerber | |
| 7,823,301 | B2 | 11/2010 | Belluto | |
| 7,827,705 | B2 | 11/2010 | Baucom et al. | |
| D631,237 | S | 1/2011 | Genuin et al. | |
| 7,866,064 | B2 | 1/2011 | Gerber | |
| 2002/0144439 | A1 | 10/2002 | Price | |
| 2003/0192199 | A1 * | 10/2003 | Nakano et al. | 36/25 R |
| 2004/0000075 | A1 | 1/2004 | Auger et al. | |
| 2004/0148806 | A1 | 8/2004 | Sussmann | |
| 2006/0150442 | A1 * | 7/2006 | Auger et al. | 36/103 |
| 2007/0062070 | A1 * | 3/2007 | Kuhtz et al. | 36/127 |
| 2007/0101618 | A1 | 5/2007 | Peake | |
| 2007/0199211 | A1 | 8/2007 | Campbell | |
| 2007/0199213 | A1 | 8/2007 | Campbell et al. | |
| 2007/0240337 | A1 * | 10/2007 | Belluto | 36/134 |
| 2008/0072458 | A1 | 3/2008 | Conneally | |
| 2008/0098624 | A1 * | 5/2008 | Goldman | 36/126 |
| 2008/0216352 | A1 | 9/2008 | Baucom et al. | |
| 2008/0216362 | A1 | 9/2008 | Gerber | |
| 2009/0100716 | A1 | 4/2009 | Gerber | |
| 2009/0113765 | A1 | 5/2009 | Robinson, Jr. et al. | |
| 2009/0235558 | A1 * | 9/2009 | Auger et al. | 36/30 R |
| 2009/0249648 | A1 * | 10/2009 | Brown et al. | 36/91 |
| 2009/0272012 | A1 | 11/2009 | Kelly | |
| 2010/0064553 | A1 | 3/2010 | Savoie et al. | |
| 2010/0139129 | A1 | 6/2010 | Kuhtz et al. | |
| 2010/0154258 | A1 | 6/2010 | Scholz et al. | |
| 2010/0229427 | A1 | 9/2010 | Campbell et al. | |
| 2011/0023329 | A1 | 2/2011 | Auger et al. | |
| 2011/0045926 | A1 | 2/2011 | Morag et al. | |
| 2011/0047834 | A1 | 3/2011 | Baker et al. | |
| 2011/0078927 | A1 | 4/2011 | Baker | |
| 2015/0196088 | A1 | 7/2015 | Minami | |

FOREIGN PATENT DOCUMENTS

| | | |
|---|---|---|
| DE | 3127793 | 1/1983 |
| DE | 3127793 C1 | 1/1983 |
| DE | 3134817 | 3/1983 |
| DE | 3438060 | 6/1985 |
| DE | 3915157 | 11/1989 |
| DE | 4417563 | 11/1995 |
| EP | 0103507 | 3/1984 |
| FR | 2188416 | 1/1974 |
| GB | 706024 | 3/1954 |
| JP | 5503740 B2 | 3/2014 |
| JP | 5503740 B2 | 5/2014 |
| KR | 1344667 | 12/2013 |
| WO | 9707700 | 3/1997 |
| WO | 9807343 | 2/1998 |

OTHER PUBLICATIONS

International Search Report and Written Opinion mailed Jan. 24, 2013 in International Application No. PCT/US2012/052609.

International Search Report and Written Opinion mailed Jan. 24, 2013 in International Application No. PCT/US2012/052613.

International Preliminary Report on Patentability mailed Mar. 27, 2014 in PCT/US2012/052613.

International Preliminary Report on Patentability mailed Mar. 27, 2014 in PCT/US2012/052605.

International Preliminary Report on Patentability mailed Mar. 27, 2014 in PCT/US2012/052609.

Response After Final Office Action filed Feb. 19, 2015 for U.S. Appl. No. 13/234,233, filed Sep. 16, 2011.

Amendment filed Sep. 25, 2014 in U.S. Appl. No. 13/234,169.

Final Office Action mailed Nov. 25, 2014 for U.S. Appl. No. 13/234,233.

(56) References Cited

OTHER PUBLICATIONS

Supplemental Amendment filed Oct. 9, 2014 in U.S. Appl. No. 13/234,169.
Final Office Action mailed Jan. 24, 2014 for U.S. Appl. No. 13/234,233.
Office Action mailed Sep. 6, 2013 for U.S. Appl. No. 13/234,233.
Office Action mailed Jul. 16, 2014 for U.S. Appl. No. 13/234,233.
Amendment filed Apr. 21, 2014 for U.S. Appl. No. 13/234,233.
Amendment filed Dec. 6, 2013 in U.S. Appl. No. 13/234,233.
Amendment filed Oct. 15, 2014 for U.S. Appl. No. 13/234,233.
Office Action issued Jun. 26, 2014 in U.S. Appl. No. 13/234,169.
Notice of Allowance issued Nov. 21, 2014 is U.S. Appl. No. 13/234,169.
Office Action issued Sep. 20, 2013 in U.S. Appl. No. 13/234,169.
Amendment filed Dec. 19, 2013 in U.S. Appl. No. 13/234,169.
Response to Written Opinion filed Jul. 24, 2014 in EP Application No. 12778478.3.
Response to Written Opinion filed Jul. 24, 2014 in EP Application No. 12778477.5.
Final Office Action mailed Jan. 24, 2014 for U.S. Appl. No. 13/234,169.
Amendment filed Apr. 21, 2014 in U.S. Appl. No. 13/234,169.
Notice of Allowance mailed Jun. 25, 2015 in U.S. Appl. No. 13/234,233.
Office Action issued May 18, 2015 in Chinese Patent Application No. 2012800563886, and English translation thereof.
Office Action issued Jun. 3, 2015 in Chinese Patent Application No. 201280056449.9, and English translation thereof.

* cited by examiner

MEDIAL ROTATIONAL TRACTION ELEMENT ARRANGEMENT FOR AN ARTICLE OF FOOTWEAR

BACKGROUND

The present invention relates to an article of footwear, and in particular to a medial rotational traction element arrangement for an article of footwear.

Articles of footwear having traction elements arranged in circular patterns have been previously proposed. Kuhtz et al. (U.S. Pat. No. 7,685,745) discloses a traction member for a shoe, including a group of large traction elements circumferentially-spaced about a periphery of a hub. Campbell et al. (US patent application publication number 2010/0229427) discloses a cleated athletic shoe with cushion structures, including protrusions arranged in a helical manner.

There exists a need in the art for a traction element arrangement that provides increased traction and mobility for an article of footwear. In particular, there exists a need in the art for a traction element arrangement that assists a wearer of an article of footwear with rotational and/or transverse movement.

SUMMARY

An article of footwear with a medial rotational traction element arrangement is disclosed. In one aspect, the invention provides an article of footwear, comprising: a sole structure including a bottom surface; a first group of traction elements disposed on the bottom surface; a second group of traction elements disposed on the bottom surface; the second group of traction elements comprising a plurality of medial rotational cleats; each medial rotational cleat comprising a plurality of stud elements extending away from the bottom surface, wherein the plurality of stud elements are arranged in a generally circular grouping; and wherein the first group of traction elements are disposed on a lateral side of the sole structure and the second group of traction elements are disposed on a medial side of the sole structure.

In another aspect, the invention provides an article of footwear, comprising: a sole structure including a bottom surface; a first group of traction elements disposed on a lateral side of the bottom surface; a second group of traction elements disposed on a medial side of the bottom surface; the first group of traction elements having a different shape than the second group of traction elements; the second group of traction elements comprising a plurality of medial rotational cleats; each medial rotational cleat comprising a plurality of stud elements extending away from the bottom surface, wherein the plurality of stud elements are arranged in a generally circular grouping; and wherein at least one stud element in each medial rotational cleat is aligned in an approximately lateral direction across the sole structure with at least one traction element associated with the first group of traction elements.

In another aspect, the invention provides a traction element arrangement for a sole structure of an article of footwear, the traction element arrangement comprising: a medial rotational traction element formed on a bottom surface of the sole structure; the medial rotational traction element comprising a raised ring extending out from the bottom surface a first height and a plurality of stud elements extending out from the bottom surface a second height, the second height being substantially larger than the first height; wherein the raised ring is disposed between at least two or more of the plurality of stud elements; and wherein the raised ring and the plurality of stud elements are arranged in an approximately circular grouping in a forefoot region on a medial side of the bottom surface.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
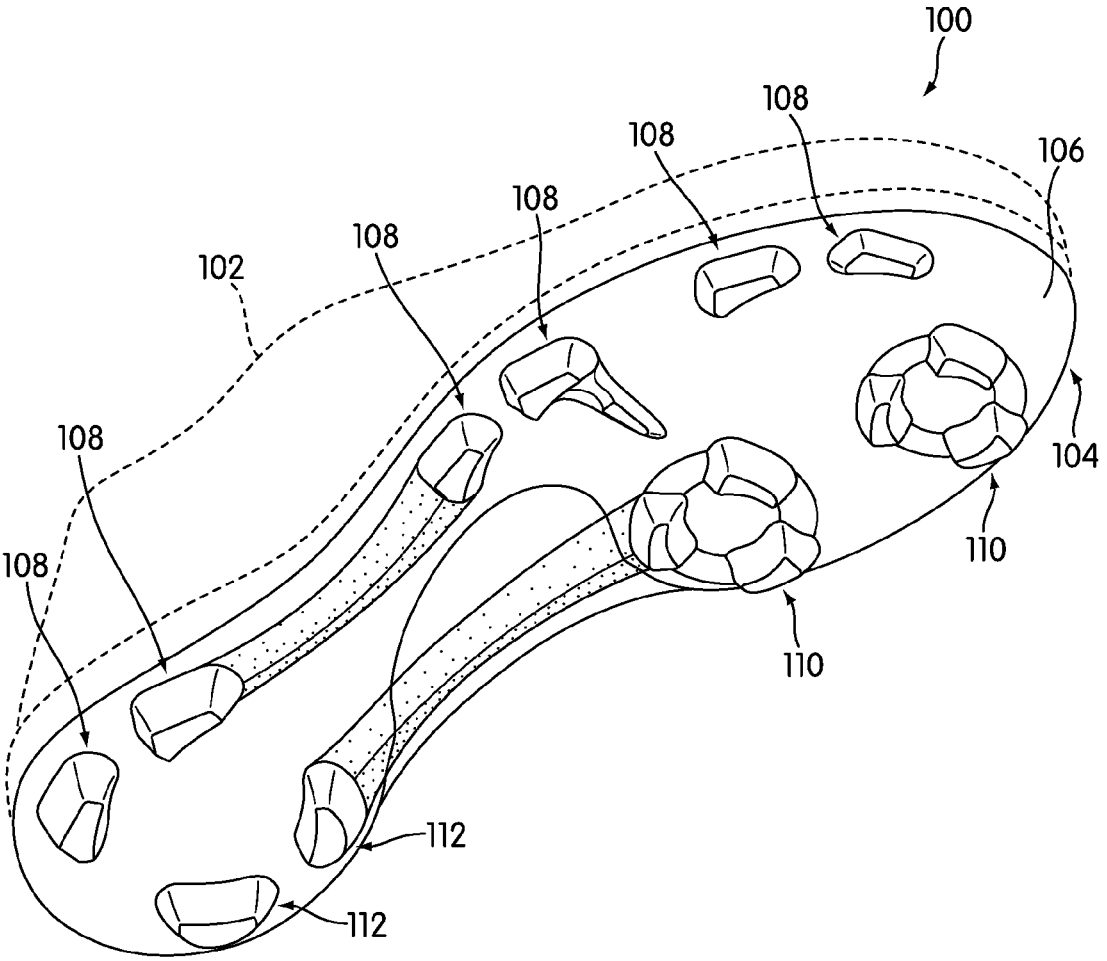
FIG. 1 is an isometric view of an article of footwear with an exemplary embodiment of a traction element arrangement.

FIG. 1 illustrates an isometric view of an exemplary embodiment of an article of footwear 100. For clarity, the following detailed description discusses an exemplary embodiment, in the form of a soccer shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

In some embodiments, article 100 may include upper 102. Generally, upper 102 may be any type of upper. In particular, upper 102 may have any design, shape, size and/or color. For example, in embodiments where article 100 is a soccer shoe, upper 102 may be a low top upper. In embodiments where article 100 is a football shoe, upper 102 may be a high top upper that is shaped to provide high support on an ankle.

As shown in FIG. 1, article 100 includes sole structure 104. In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. Sole structure 104 extends between upper 102 and the ground when article 100 is worn. In different embodiments, sole structure 104 may include different components. For example, sole structure 104 may include an outsole, a midsole, and/or an insole. In some cases, one or more of these components may be optional.

In some embodiments, sole structure 104 may be constructed of a lightweight and flexible material. In some embodiments, sole structure 104 may be constructed of a plastic material. In an exemplary embodiment, sole structure 104 may be constructed of a plastic molding, including, but not limited to Pebax® or other thermoplastic elastomers, thermoplastic polyurethane (TPU), or carbon fiber.

In some cases, sole structure 104 may be configured according to one or more types of ground surfaces on which sole structure 104 may be used. Examples of ground surfaces include, but are not limited to: natural turf, synthetic turf, dirt, natural grass, soft natural grass, as well as other surfaces. In some embodiments, sole structure 104 may be provided with one or more types of traction elements with various arrangements on a bottom surface 106 of sole structure 104. The term "traction elements" as used in this detailed description and throughout the claims includes any provisions disposed on a sole structure for increasing traction through friction or penetration of a ground surface, including, but not limited to cleats, studs, projections, or treads. Typically, traction elements may be configured for football, soccer, baseball or any type of activity that requires traction with a ground surface.

Sole structure 104 may include one or more groups of traction elements, each group comprising a plurality of traction elements that extend away from sole structure 104. In an exemplary embodiment, sole structure 104 may include a first group of traction elements 108 and a second group of traction elements 110. In this embodiment, first group of traction elements 108 and second group of traction elements 110 may be different types of traction elements, discussed in more detail below. In some embodiments, sole structure 104 may include a third group of traction elements 112. In this embodiment, third group of traction elements 112 may be a different type of traction element from either or both of first group of traction elements 108 and second group of traction elements 110. In other embodiments, third group of traction elements 112 may be similar to first group of traction elements 108. In other embodiments, sole structure 104 may include any number of different or similar groups of traction elements.

Generally, traction elements may be associated with sole structure 104 in any manner. In some embodiments, traction elements may be integrally formed with sole structure 104. In other embodiments, sole structure 104 may include a partially rigid plate that extends across a substantial majority of a lower surface of sole structure 104. In some cases, traction elements may be attached to a partially rigid plate, such as by being screwed into holes within the plate or using any other provisions. Still further, in some cases, some traction elements may be integrally formed with sole structure 104, while other traction elements may be attached to and/or integrally formed with a partially rigid plate.

Figure 2:
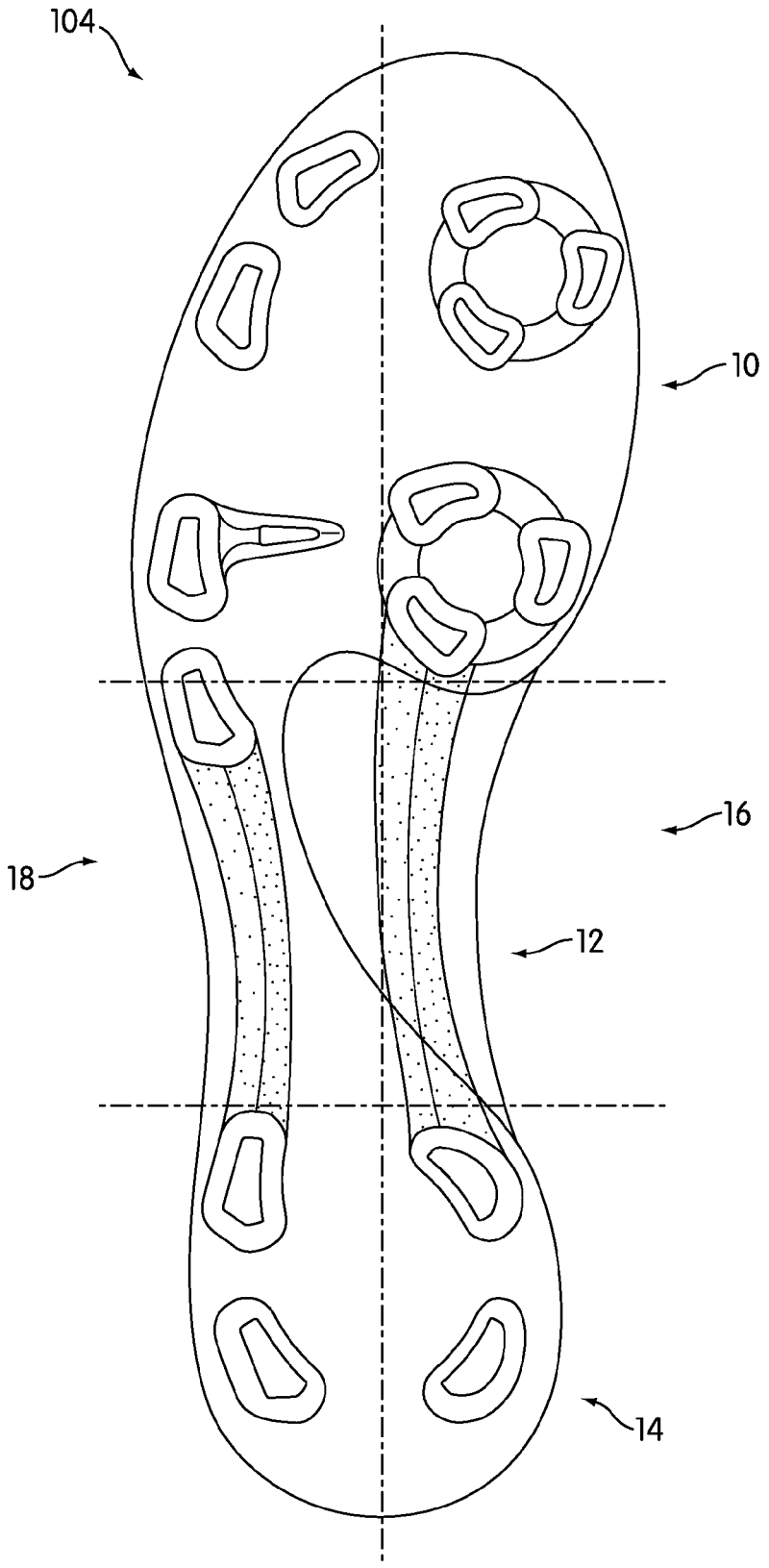
FIG. 2 is a schematic view of an exemplary embodiment of a traction element arrangement.

Referring to FIG. 2, for purposes of reference, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12, and heel region 14.

It will be understood that forefoot region 10, midfoot region 12, and heel region 14 are only intended for purposes of description and are not intended to demarcate precise regions of article 100. Likewise, medial side 16 and lateral side 18 are intended to represent generally two sides of an article, rather than precisely demarcating article 100 into two halves. In addition, forefoot region 10, midfoot region 12, and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

An article of footwear including a sole structure with a traction element arrangement may include provisions configured to assist with interaction between the sole structure and the ground surface. In some embodiments, the arrangement of traction elements may be configured to provide increased traction for an article of footwear. In other embodiments, a traction element arrangement may include provisions configured to assist with mobility of a wearer of an article of footwear on a ground surface. In an exemplary embodiment, a traction element arrangement may be provided to assist a wearer of an article of footwear with rotational and/or transverse movement. In other embodiments, an article may include a traction element arrangement that assists a wearer with movement in other directions.

Figure 3:
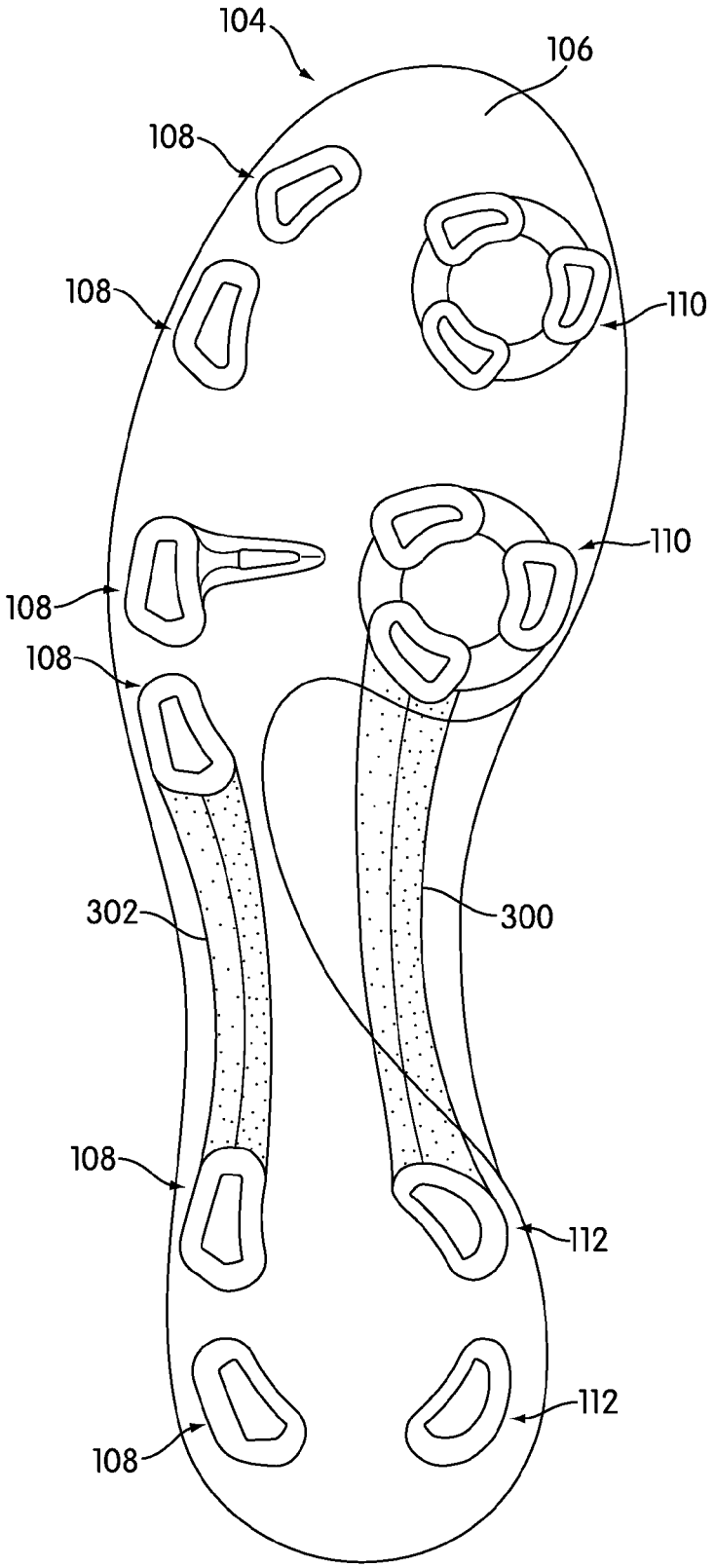
FIG. 3 is a top view of an exemplary embodiment of a traction element arrangement.

Referring now to FIG. 3, a top view of an exemplary embodiment of a traction element arrangement on sole structure 104 is illustrated. In one embodiment, the traction element arrangement on sole structure 104 may include first group of traction elements 108 and second group of traction elements 110. In this embodiment, the arrangement of first group of traction elements 108 and second group of traction elements 110 may be configured to assist a wearer of article 100 with rotational and/or transverse movement. In some embodiments, first group of traction elements 108, discussed in more detail below, may be individual cleats or studs arranged separately along sole structure 104. In an exemplary embodiment, second group of traction elements 110, discussed in more detail below, may be rotational traction elements arranged in an approximately circular grouping of multiple studs and/or projections along medial side 16 of sole structure 104. With this arrangement, the traction element arrangement on sole structure 104 may be configured to assist a wearer of article 100 with rotational and/or transverse movement.

In addition, in some embodiments, sole structure 104 may include third group of traction elements 112. In this embodiment, third group of traction elements 112 may be individual cleats or studs arranged separately along heel region 14 of sole structure 104. In one embodiment, third group of traction elements 112 may be arranged on medial side 16 of heel region 14. In an exemplary embodiment, third group of traction elements 112 may have a different shape than first group of traction elements 108. In one embodiment, third group of traction elements 112 may have a generally rounded or half-circle shape. In another embodiment, third group of traction elements 112 may be substantially similar to first group of traction elements 108, including any of the various shapes discussed below. Various embodiments of traction element arrangements will be further described with reference to the embodiments discussed below.

In some embodiments, sole structure 104 may include one or more additional components configured to provide support and/or stability to article 100. In an exemplary embodiment, sole structure 104 may include one or more support ribs. In some embodiments, support ribs may generally run longitudinally along sole structure 104 from heel region 14 through midfoot region 12 to forefoot region 10. Support ribs may be configured to provide additional strength or rigidity to portions of sole structure 104. As shown in FIG. 3, sole structure 104 may include a medial rib 300 disposed on medial side 16 in midfoot region 12. With this arrangement, medial rib 300 may be configured to support an arch of a wearer. In some embodiments, sole structure 104 may also include a lateral rib 302 disposed on lateral side 18 in midfoot region 12. With this arrangement, lateral rib 302 may be configured to further support a foot of a wearer.

In various embodiments, medial rib 300 and/or lateral rib 302 may be made of any material configured to provide support. In an exemplary embodiment, medial rib 300 and/or lateral rib 302 may be made of a substantially similar material as sole structure 104, described above. In other embodiments, however, one or more portions of medial rib 300 and/or lateral rib 302 may be made of different materials, including but not limited to plastics, metal, carbon fiber or other composite materials. In addition, in some embodiments, one or more of medial rib 300 and lateral rib 302 are optional and may be omitted.

Figure 4:
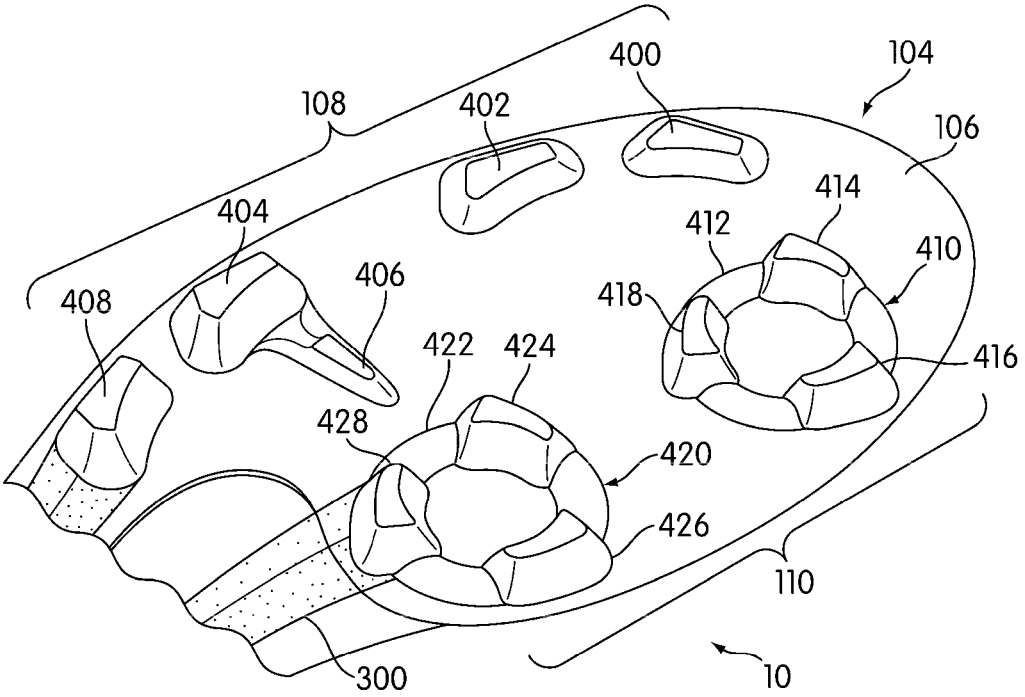
FIG. 4 is an isometric view of a forefoot region of a sole structure including an exemplary embodiment of a traction element arrangement.

FIG. 4 is an isometric view of forefoot region 10 of sole structure 104 including an exemplary embodiment of a traction element arrangement. In some embodiments, sole structure 104 may include one or more different groups of traction elements. In this embodiment, forefoot region 10 of sole structure 104 may include first group of traction elements 108 and second group of traction elements 110. In an exemplary embodiment, first group of traction elements 108 may be a different type of traction element as second group of traction elements 110. In some embodiments, different groups of traction elements may be arranged at different portions of sole structure 104. In an exemplary embodiment, first group of traction elements 108 may be arranged along lateral side 18 of forefoot region 10 of sole structure 104. In addition, in some embodiments, first group of traction elements 108 may extend further into midfoot region 12 and/or heel region 14. In one embodiment, second group of traction elements 110 may be arranged along medial side 16 of forefoot region 10 of sole structure 104.

In an exemplary embodiment, first group of traction elements 108 may be arranged adjacent to the periphery of bottom surface 106 along lateral side 18. In this embodiment, first group of traction elements 108 includes a first lateral cleat 400, a second lateral cleat 402, a third lateral cleat 404, and a fourth lateral cleat 408. In different embodiments, first group of traction elements 108 may include more or less individual traction elements. In some embodiments, one or more of the traction elements of first group of traction elements 108 may include a secondary stud. In this embodiment, third lateral cleat 404 includes secondary stud 406. In an exemplary embodiment, secondary stud 406 may be arranged approximately perpendicular to third lateral cleat 404 and oriented in a generally lateral direction across sole structure 104. In other embodiments, secondary stud 406 may have a different orientation. In this embodiment, secondary stud 406 may be connected to third lateral cleat 404. In other embodiments, secondary stud 406 may be separate from third lateral cleat 404. In addition, in some embodiments, secondary stud 406 is optional and may be omitted.

In various embodiments, traction elements associated with first group of traction elements 108 may have different shapes. In an exemplary embodiment, traction elements in first group of traction elements 108 may have a generally curved airfoil shape. In this embodiment, first lateral cleat 400, second lateral cleat 402, third lateral cleat 404, and/or fourth lateral cleat 408 may have a generally curved airfoil shape. The generally curved airfoil shape may be associated with a wide end facing towards heel region 14 and a narrow end facing towards forefoot region 10. In some cases, the traction element may taper from the wide end to the narrow end. As shown in FIG. 4, each of first lateral cleat 400, second lateral cleat 402, third lateral cleat 404, and/or fourth lateral cleat 408 have a shape associated with a wide end facing towards heel region 14 and a narrow end facing towards forefoot region 10. In other embodiments, however, first group of traction elements 108, including first lateral cleat 400, second lateral cleat 402, third lateral cleat 404, and/or fourth lateral cleat 408, may have different shapes, including but not limited to hexagonal, cylindrical, conical, circular, square, rectangular, trapezoidal, diamond, ovoid, as well as other regular or irregular and geometric or non-geometric shapes.

In an exemplary embodiment, second group of traction elements 110 may be arranged adjacent to the periphery of bottom surface 106 along medial side 16. In one embodiment, second group of traction elements 110 may include rotational traction elements arranged in an approximately circular grouping of multiple projections. In this embodiment, second group of traction elements 110 includes a first medial rotational cleat 410 and a second medial rotational cleat 420. In some embodiments, first medial rotational cleat 410 may include multiple projections arranged along a raised ring 412 extending above bottom surface 106 of sole structure 104. In this embodiment, first medial rotational cleat 410 includes a first stud element 414, a second stud element 416 and a third stud element 418 disposed on raised ring 412.

In an exemplary embodiment, first stud element 414, second stud element 416 and/or third stud element 418 may have a generally curved airfoil shape. The generally curved airfoil shape may be associated with a wide end that tapers to a narrow end in a clockwise direction. As shown in FIG. 4, each of first stud element 414, second stud element 416 and/or third stud element 418 have a shape associated with a wide end tapering to a narrow end in clockwise direction. With this arrangement, the stud elements disposed on first medial rotational cleat 410 may assist a wearer when making a clockwise rotational movement with article 100. However, in other embodiments, the stud elements may taper in a different direction or orientation and/or may have different shapes, including but not limited to hexagonal, cylindrical, conical, circular, square, rectangular, trapezoidal, diamond, ovoid, as well as other regular or irregular and geometric or non-geometric shapes.

In some embodiments, second group of traction elements 110 may include second medial rotational cleat 420. In an exemplary embodiment, second medial rotational cleat 420 may be arranged below first medial rotational cleat 410 in forefoot region 10 adjacent to the periphery of bottom surface 106 along medial side 16. First medial rotational cleat 410 may be spaced apart from second medial rotational cleat 420 such that the medial rotational cleats do not intersect, overlap, or lie within one another. For example, the ring and studs of the first medial rotational cleat may be disposed such that the first medial rotational cleat does not intersect with the ring and studs of the second medial rotational cleat. First medial rotational cleat 410 and second medial rotational cleat 420 may not be concentric. In an exemplary embodiment, second medial rotational cleat 420 includes a first stud element 424, a second stud element 426 and a third stud element 428 disposed on a raised ring 422. In this embodiment, first medial rotational cleat 410 and second medial rotational cleat 420 may be substantially similar. In addition, in this embodiment, the shape and/or arrangement of first stud element 424, second stud element 426 and third stud element 428 along raised ring 422 may be substantially similar as first stud element 414, second stud element 416 and third stud element 418 along raised ring 412. In other embodiments, first medial rotational cleat 410 and second medial rotational cleat 420 may be different, including different shapes of stud elements, arrangement of stud elements along the raised ring, as well as size, heights, and other characteristics of stud elements. In at least one of the aspects in the figures, first medial rotational cleat 410 and second medial rotational cleat 420 may not share any stud elements in common.

Figure 5:
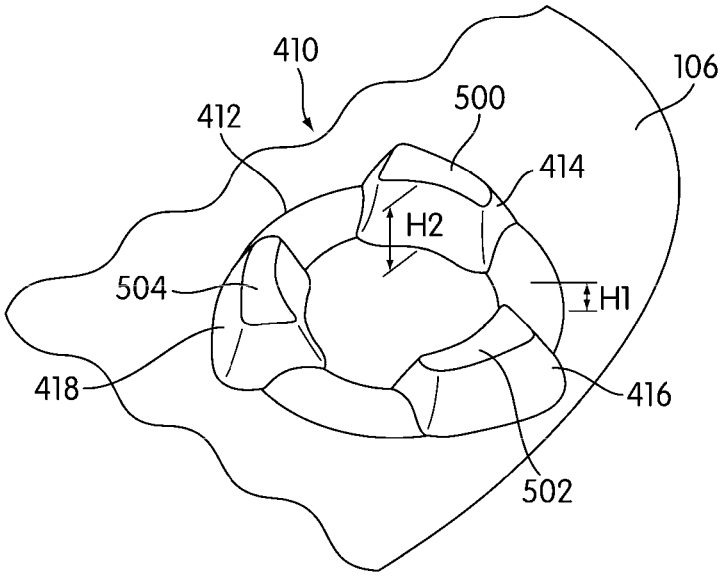
FIG. 5 is an enlarged view of an exemplary embodiment of a medial rotational traction element.

FIG. 5 is an enlarged view of first medial rotational cleat 410. In this embodiment, first medial rotational cleat 410 includes first stud element 414, second stud element 416 and third stud element 418 disposed on raised ring 412 above bottom surface 106 of sole structure 104. In some embodiments, first stud element 414, second stud element 416 and/or third stud element 418 may have a generally circular arrangement along raised ring 412. In other embodiments, however, stud elements may be disposed on a raised ring or lip in different arrangements to form first medial rotational cleat 410, including but not limited to elliptical, oval, crescent, parabolic, as well as other regular or irregular arrangements. In the illustrated embodiment, first medial rotational cleat 410 includes three stud elements disposed generally uniformly around raised ring 412 approximately 120 degrees apart. In other embodiments, however, first medial rotation cleat 410 may include more or less stud elements. In addition, in other embodiments, the stud elements need not be distributed generally uniformly around raised ring 412 approximately every 120 degrees. Instead, stud elements may be disposed unevenly at different angular positions around raised ring 412.

In some embodiments, one or more components of first medial rotational cleat 410 may be associated with different heights above bottom surface 106 of sole structure. In an exemplary embodiment, raised ring 412 may be associated with a first height H1 above bottom surface 106. In some cases, first height H1 may be from 1 mm to 1.5 mm. In other cases, first height H1 may be less than 1 mm.

In an exemplary embodiment, each of the stud elements, including first stud element 414, second stud element 416 and third stud element 418 may be associated with a ground-engaging face that is disposed a second height H2 above bottom surface 106. In this embodiment, first stud element 414 has a first ground-engaging face 500, second stud element 416 has a second ground-engaging face 502 and third stud element 418 has a third ground-engaging face 504. In this embodiment, each stud element may be a substantially similar height above bottom surface 106. In other embodiments, the stud elements may be different heights above bottom surface 106. In some cases, second height H2 may be from 3 mm to 6 mm. In other cases, second height H2 may be from 4 mm to 8 mm. In still other cases, second height H2 may be smaller or larger. In an exemplary embodiment, second height H2 associated with first stud element 414, second stud element 416 and/or third stud element 418 may be substantially larger than first height H1 associated with raised ring 412. In other embodiments, however, second height H2 may be only slightly larger than first height H1.

Figure 6:
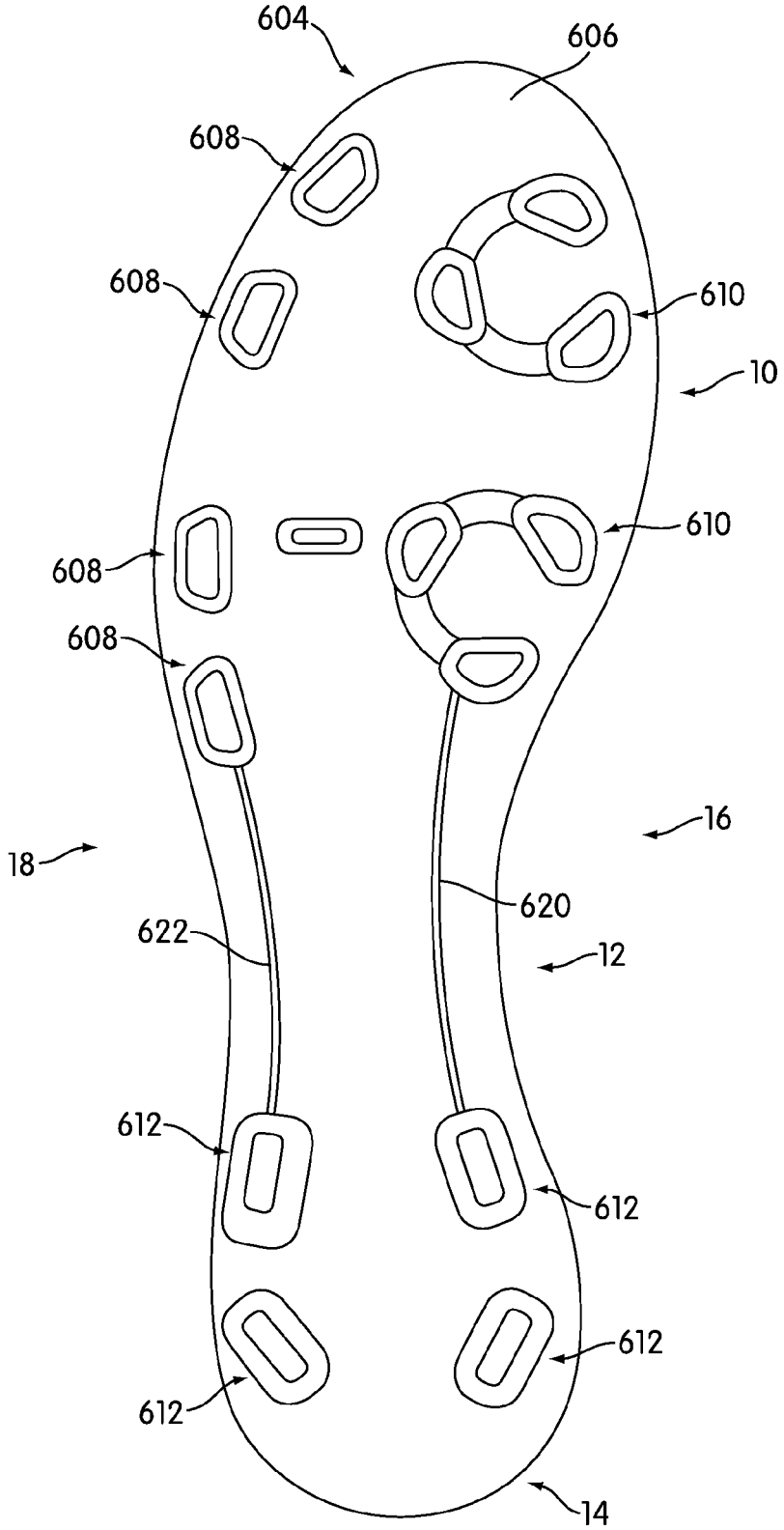
FIG. 6 is a top view of an alternate embodiment of a traction element arrangement.

In some embodiments, the shape, configuration and/or arrangement of groups of traction elements on a sole structure may vary. Referring now to FIG. 6, a top view of an alternate embodiment of a traction element arrangement on a sole structure 604 is illustrated.

In one embodiment, the traction element arrangement on sole structure 604 may include first group of traction elements 608, a second group of traction elements 610, and/or a third group of traction elements 612. In this embodiment, the arrangement of first group of traction elements 608, second group of traction elements 610, and third group of traction elements 612 may be configured to assist a wearer of article 100 with rotational and/or transverse movement. In some embodiments, first group of traction elements 608, discussed in more detail below, may be individual cleats or studs arranged separately along lateral side 18 of sole structure 604. In an exemplary embodiment, second group of traction elements 610, discussed in more detail below, may be rotational traction elements arranged in an approximately semi-circular grouping of multiple studs and/or projections along medial side 16 of sole structure 604. In addition, third group of traction elements 612 may be individual cleats or studs arranged separately along heel region 14 of sole structure 104. In one embodiment, third group of traction elements 612 may be arranged on lateral side and/or medial side 16 of heel region 14. With this arrangement, the traction element arrangement on sole structure 604 may be configured to assist a wearer of article 100 with rotational and/or transverse movement.

In an exemplary embodiment, third group of traction elements 612 may have a different shape than first group of traction elements 608. In one embodiment, third group of traction elements 612 may have a generally rectangular shape. In another embodiment, third group of traction elements 612 may be substantially similar to first group of traction elements 608, including any of the various shapes discussed herein.

In some embodiments, sole structure 604 may include one or more additional components configured to provide support and/or stability to article 100. In an exemplary embodiment, sole structure 604 may include one or more support ribs. In some embodiments, support ribs may generally run longitudinally along sole structure 604 from heel region 14 through midfoot region 12 to forefoot region 10. Support ribs may be configured to provide additional strength or rigidity to portions of sole structure 604. As shown in FIG. 6, sole structure 604 may include a medial rib 620 disposed on medial side 16 in midfoot region 12. With this arrangement, medial rib 620 may be configured to support an arch of a wearer. In some embodiments, sole structure 604 may also include a lateral rib 622 disposed on lateral side 18 in midfoot region 12. With this arrangement, lateral rib 622 may be configured to further support a foot of a wearer. In an exemplary embodiment, medial rib 620 and/or lateral rib 622 may be smaller and/or narrower than medial rib 300 and/or lateral rib 302, discussed above.

In various embodiments, medial rib 620 and/or lateral rib 622 may be made of any material configured to provide support. In an exemplary embodiment, medial rib 620 and/or lateral rib 622 may be made of a substantially similar material as sole structure 604, described above. In other embodiments, however, one or more portions of medial rib 620 and/or lateral rib 622 may be made of different materials, including the materials discussed above in reference to medial rib 300 and/or lateral rib 302. In addition, in some embodiments, one or more of medial rib 620 and lateral rib 622 are optional and may be omitted.

Figure 7:
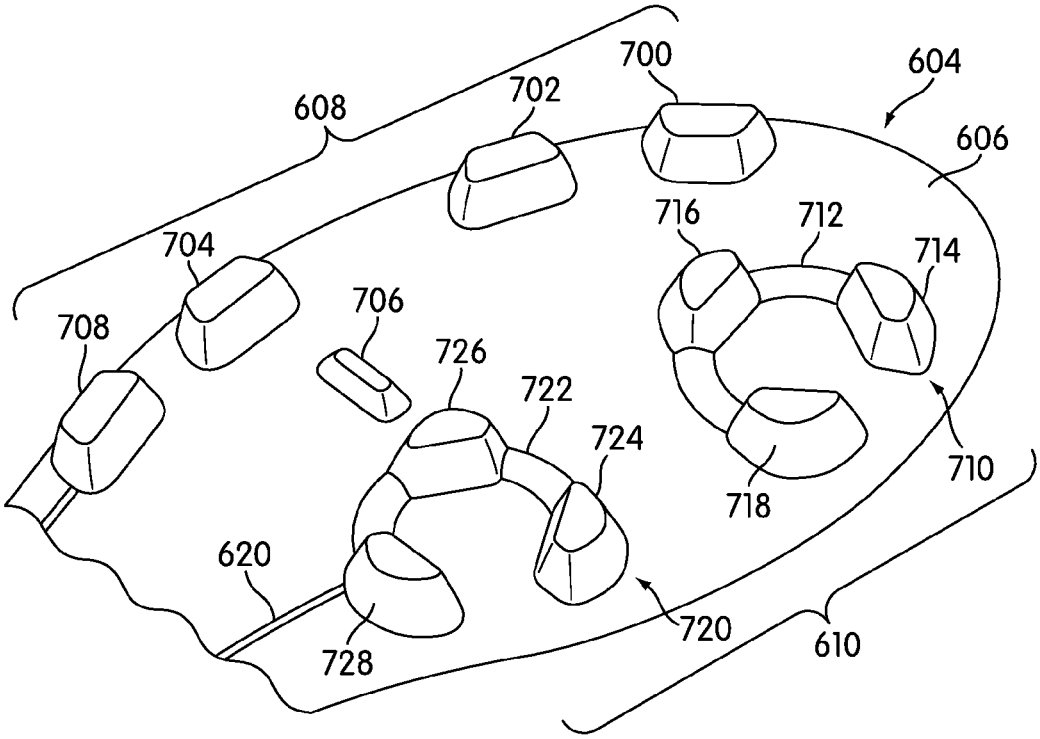
FIG. 7 is an isometric view of a forefoot region of a sole structure including an alternate embodiment of a traction element arrangement.

Referring now to FIG. 7, an isometric view of forefoot region 10 of sole structure 604 including an alternate embodiment of a traction element arrangement is illustrated. In this embodiment, forefoot region 10 of sole structure 604 may include first group of traction elements 608 and second group of traction elements 610. In an exemplary embodiment, first group of traction elements 608 may be a different type of traction element as second group of traction elements 610. In some embodiments, different groups of traction elements may be arranged at different portions of sole structure 604. In an exemplary embodiment, first group of traction elements 608 may be arranged along lateral side 18 of forefoot region 10 of sole structure 604. In addition, in some embodiments, first group of traction elements 608 may extend further into midfoot region 12. In one embodiment, second group of traction elements 610 may be arranged along medial side 16 of forefoot region 10 of sole structure 604.

In an exemplary embodiment, first group of traction elements 608 may be arranged adjacent to the periphery of bottom surface 606 along lateral side 18. In this embodiment, first group of traction elements 608 includes a first lateral cleat 700, a second lateral cleat 702, a third lateral cleat 704, and a fourth lateral cleat 708. In different embodiments, first group of traction elements 608 may include more or less individual traction elements. In some embodiments, a secondary stud may be disposed adjacent to one or more of the traction elements of first group of traction elements 608. In this embodiment, secondary stud 706 is disposed adjacent to third lateral cleat 704. In an exemplary embodiment, secondary stud 706 may be arranged approximately perpendicular to third lateral cleat 704 and oriented in a generally lateral direction across sole structure 604. In other embodiments, secondary stud 706 may have a different orientation. In contrast to secondary stud 406, described above, secondary stud 706 may be separate from the traction elements in the first group of traction elements 608. In other embodiments, however, secondary stud 706 may be connected to third lateral cleat 704. In addition, in some embodiments, secondary stud 706 is optional and may be omitted.

In various embodiments, traction elements associated with first group of traction elements 608 may have different shapes. In an exemplary embodiment, traction elements in first group of traction elements 608 may have a generally curved trapezoidal shape. In this embodiment, first lateral cleat 700, second lateral cleat 702, third lateral cleat 704, and/or fourth lateral cleat 708 may have a generally curved trapezoidal shape. The generally curved trapezoidal shape may be associated with a wide face and a narrow face, with the wide face representing the base of the trapezoid and the narrow face representing the top of the trapezoid.

In some cases, traction elements may be arranged with similar orientations of the narrow face. As shown in FIG. 7, each of second lateral cleat 702, third lateral cleat 704, and/or fourth lateral cleat 708 have a shape associated with a wide face oriented towards medial side 16 and a narrow face oriented towards lateral side 18. In other cases, one or more traction elements may be arranged with an opposite orientation. In this embodiment, first lateral cleat 700 has a shape orientated opposite that of second lateral cleat 702, third lateral cleat 704, and/or fourth lateral cleat 708. As shown in FIG. 7, first lateral cleat 700, which is located at the top most portion of forefoot region 10, has a shape associated with a wide face oriented towards lateral side 18 and a narrow face oriented towards medial side 16. With this arrangement, orientation of first lateral cleat 700 may be configured to assist a wearer of article 100 with rotational and/or transverse movement.

In the embodiment illustrated in FIG. 7, first group of traction elements have a generally trapezoidal shape. In other embodiments, first group of traction elements 608, including first lateral cleat 700, second lateral cleat 702, third lateral cleat 704, and/or fourth lateral cleat 708, may have different shapes, including but not limited to hexagonal, cylindrical, conical, circular, square, rectangular, trapezoidal, diamond, ovoid, as well as other regular or irregular and geometric or non-geometric shapes.

In an exemplary embodiment, second group of traction elements 610 may be arranged adjacent to the periphery of bottom surface 606 along medial side 16. In one embodiment, second group of traction elements 610 may include rotational traction elements arranged in an approximately semi-circular grouping of multiple studs and/or projections. In this embodiment, second group of traction elements 610 includes a first medial rotational cleat 710 and a second medial rotational cleat 720. In some embodiments, first medial rotational cleat 710 may include multiple studs and/or projections arranged in a semi-circle along a raised ring 712 extending above bottom surface 606 of sole structure 604. In this embodiment, first medial rotational cleat 710 includes a first stud element 714, a second stud element 716 and a third stud element 718 disposed on raised ring 712.

In some embodiments, the approximately semi-circular grouping of studs and/or projections on first medial rotational cleat 710 and/or second medial rotational cleat 720 may be varied. In an exemplary embodiment, first medial rotational cleat 710 may include first stud element 714, second stud element 716 and third stud element 718 disposed in a generally c-shaped arrangement along raised ring 712. In one embodiment, raised ring 712 may be open or discontinuous at one or more portions. In this embodiment, raised ring 712 may include an opening between first stud element 714 and third stud element 718 facing medial side 16. In other embodiments, raised ring 712 may be closed, similar to raised ring 412 discussed above.

In an exemplary embodiment, first stud element 714, second stud element 716 and/or third stud element 718 may have a generally rounded or half-circle shape. The generally rounded or half-circle shape may be associated with a flat face on one side and a rounded or curved face on the opposite side. As shown in FIG. 7, each of first stud element 714, second stud element 716 and/or third stud element 718 have a shape associated with a flat face oriented towards the inside of first medial rotational cleat 710 and a rounded or curved face oriented towards the outside of first medial rotational cleat 710. With this arrangement, the stud elements disposed on first medial rotational cleat 710 may assist a wearer when making a clockwise rotational movement with article 100. However, in other embodiments, the stud elements may have flat or curved faces oriented in a different direction or orientation and/or may have different shapes, including but not limited to hexagonal, cylindrical, conical, circular, square, rectangular, trapezoidal, diamond, ovoid, as well as other regular or irregular and geometric or non-geometric shapes.

In some embodiments, second group of traction elements 610 may include second medial rotational cleat 720. In an exemplary embodiment, second medial rotational cleat 720 may be arranged below first medial rotational cleat 710 in forefoot region 10 adjacent to the periphery of bottom surface 606 along medial side 16. First medial rotational cleat 710 may be spaced apart from second medial rotational cleat 720 such that the medial rotational cleats do not intersect, overlap, or lie within one another. For example, the ring and studs of the first medial rotational cleat may be disposed such that the first medial rotational cleat does not intersect with the ring and studs of the second medial rotational cleat. First medial rotational cleat 710 and second medial rotational cleat 720 may not be concentric. In an exemplary embodiment, second medial rotational cleat 720 includes a first stud element 724, a second stud element 726 and a third stud element 428 disposed on a raised ring 722. In this embodiment, first medial rotational cleat 710 and second medial rotational cleat 720 may be substantially similar. In addition, in this embodiment, the shape and/or arrangement of first stud element 724, second stud element 726 and third stud element 728 along raised ring 722 may be substantially similar as first stud element 714, second stud element 716 and third stud element 718 along raised ring 712. In other embodiments, first medial rotational cleat 710 and second medial rotational cleat 720 may be different, including different shapes of stud elements, arrangement of stud elements along the raised ring, as well as size, heights, and other characteristics of stud elements. In at least one of the aspects in the figures, first medial rotational cleat 710 and second medial rotational cleat 720 may not share any stud elements in common.

Figure 8:
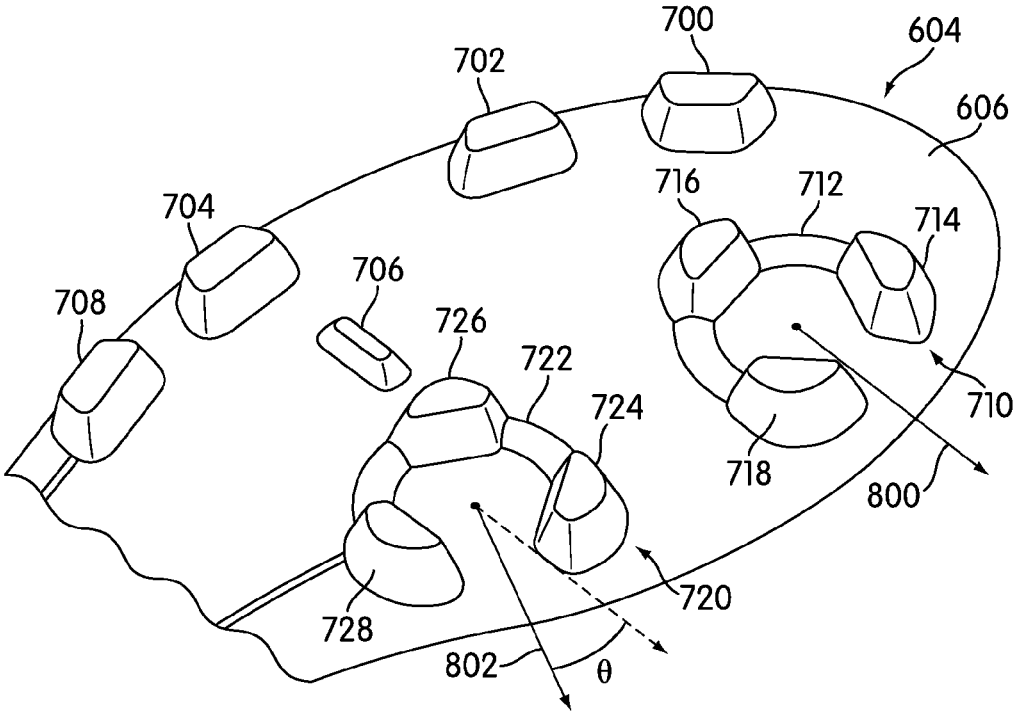
FIG. 8 is a schematic view of a forefoot region of a sole structure including an alternate embodiment of a traction element arrangement.

Referring now to FIG. 8, a schematic view of forefoot region 10 of sole structure 604 including an alternate embodiment of a traction element arrangement is illustrated. In some embodiments, one or more rotational traction elements in second group of traction elements 610 may be arranged with varying orientations on sole structure 604. In an exemplary embodiment, first medial rotational cleat 710 and second medial rotational cleat 720 may be arranged along medial side 16 with different orientations. In one embodiment, the orientation of first medial rotational cleat 710 may be a first direction 800. In this embodiment, the orientation of first medial rotational cleat 710 corresponds to first direction 800 of the opening in raised ring 712 between first stud element 714 and third stud element 718 facing medial side 16. In some cases, first direction 800 may be generally a transverse or lateral direction across sole structure 604. In other cases, first direction 800 may have a different orientation.

In an exemplary embodiment, second medial rotational cleat 720 may have an orientation that is in a skewed direction with respect to first direction 800 associated with first medial rotational cleat 710. As shown in FIG. 8, the orientation of second medial rotational cleat 720 corresponds to second direction 802 of the opening in raised ring 722 between first stud element 724 and third stud element 728 facing medial side 16. In an exemplary embodiment, second direction 802 is generally oriented in a direction towards midfoot region 12. In other embodiments, second direction 802 may be oriented in a direction towards forefoot region 10 and/or may be substantially similar to first direction 800. In some embodiments, second direction 802 may skewed from first direction 800 by an offset angle θ. In one embodiment, offset angle θ may be an acute angle less than 90 degrees. In another embodiment, offset angle θ may be substantially less than 90 degrees. In different embodiments, offset angle θ may range from zero to 90 degrees.

In some cases, the orientation of first medial rotational cleat 710 and/or second medial rotational cleat 720 may be configured to assist a wearer with transverse and/or rotational movement. In an exemplary embodiment, first medial rotational cleat 710 oriented with first direction 800 in approximately a lateral or transverse direction may assist with a wearer making a first step in a lateral or transverse direction when leading with medial side 16 of article 100. Similarly, second medial rotational cleat 720 oriented with second direction 802 skewed from first direction 800 may assist with a wearer making a rotational movement. In other cases, the location of first medial rotational cleat 710 and/or second medial rotational cleat 720 on sole structure 604 may be configured to correspond with one or more portions of a foot of a wearer. In an exemplary embodiment, first medial rotational cleat 710 may be located on sole structure 604 so as to correspond to a big toe of a wearer. Similarly, second medial rotational cleat 720 may be located on sole structure 604 so as to correspond to a ball of a foot of the wearer. With this arrangement, the location of first medial rotational cleat 710 and/or second medial rotational cleat 720 may further assist with rotational and/or transverse movement. In other embodiments, first medial rotational cleat 710 and/or second medial rotational cleat 720 may have different locations on sole structure 604.

Figure 9:
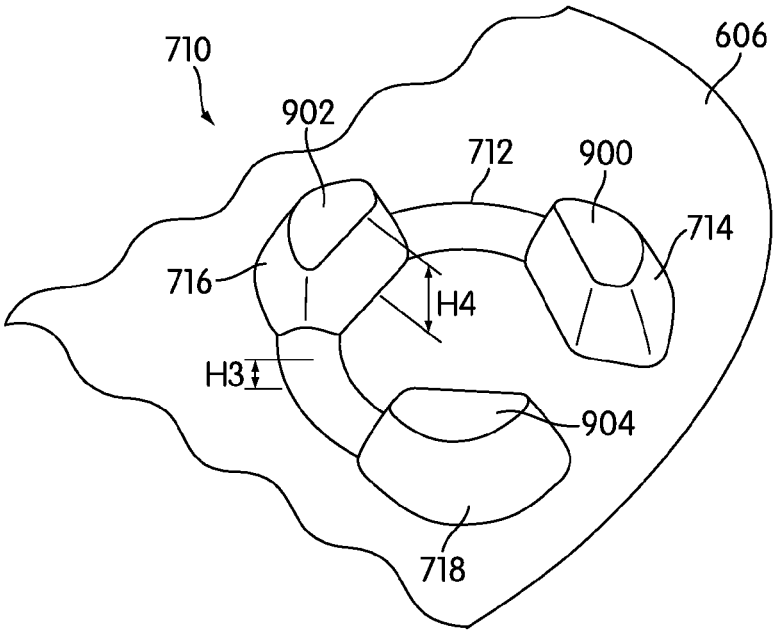
FIG. 9 is an enlarged view of an alternate embodiment of a medial rotational traction element.

FIG. 9 is an enlarged view of an alternate embodiment of first medial rotational cleat 710. In this embodiment, first medial rotational cleat 710 includes first stud element 714, second stud element 716 and third stud element 718 disposed on raised ring 712 above bottom surface 606 of sole structure 604. In some embodiments, first stud element 714, second stud element 716 and/or third stud element 718 may have a generally semi-circular arrangement along raised ring 712. In other embodiments, however, stud elements may be disposed on a raised ring or lip in different arrangements to form first medial rotational cleat 710, including but not limited to elliptical, oval, crescent, parabolic, as well as other regular or irregular arrangements.

In an exemplary embodiment, the approximately semi-circular grouping of projections on first medial rotational cleat 710 may be arranged approximately in an arc of 270 degrees. In the illustrated embodiment, first medial rotational cleat 710 includes three stud elements disposed generally uniformly around raised ring 712 approximately 90 degrees apart. In other embodiments, however, first medial rotation cleat 710 may include more or less stud elements. In addition, in other embodiments, the stud elements need not be distributed generally uniformly around raised ring 712 approximately every 90 degrees. Instead, stud elements may be disposed unevenly at different angular positions around raised ring 712. In addition, in different embodiments, the approximately semi-circular grouping of projections may be arranged in arcs that are larger or smaller than 270 degrees.

In some embodiments, one or more components of first medial rotational cleat 710 may be associated with different heights above bottom surface 606 of sole structure. In an exemplary embodiment, raised ring 712 may be associated with a third height H3 above bottom surface 606. In some cases, third height H3 may be substantially similar to first height H1 of raised ring 412, discussed above. In other cases, third height H3 of raised ring 712 may be larger or smaller than first height H1.

In an exemplary embodiment, each of the stud elements, including first stud element 714, second stud element 716 and third stud element 718 may be associated with a ground-engaging face that is disposed a fourth height H4 above bottom surface 606. In this embodiment, first stud element 714 has a first ground-engaging face 900, second stud element 716 has a second ground-engaging face 902 and third stud element 718 has a third ground-engaging face 904. In this embodiment, each stud element may be a substantially similar height above bottom surface 606. In other embodiments, the stud elements may be different heights above bottom surface 606. In some cases, fourth height H4 may be substantially similar to second height H2 associated with the stud elements of first medial rotational cleat 410, discussed above. In other cases, fourth height H4 may be smaller or larger than second height H2. In an exemplary embodiment, fourth height H4 associated with first stud element 714, second stud element 716 and/or third stud element 718 may be substantially larger than third height H3 associated with raised ring 712. In other embodiments, however, fourth height H4 may be only slightly larger than third height H3.

In some embodiments, the arrangement of traction elements on lateral side 18 and/or medial side 16 of a sole structure may be configured to assist a wearer with rotational and/or transverse movement. In an exemplary embodiment, the arrangement of traction elements on a sole structure of an article may be configured to assist with a specific sport and/or a particular position. In some cases, article 100 may be configured for playing soccer. In one embodiment, the arrangement of traction elements on a sole structure of article 100 may be configured to assist a wearer with rotational and/or transverse movement associated with a soccer midfielder. In other cases, article 100 may be configured with a different arrangement configured to assist a wearer with movements associated with other positions and/or sports.

Figure 10:
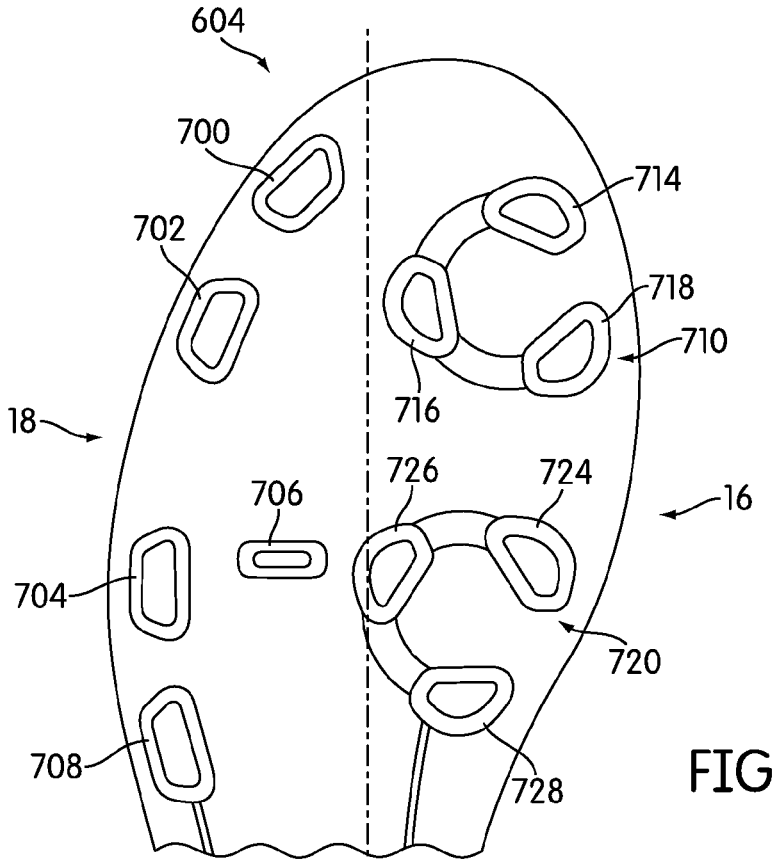
FIG. 10 is a schematic view of a forefoot region of a sole structure including an alternate embodiment of a traction element arrangement.
Figure 11:
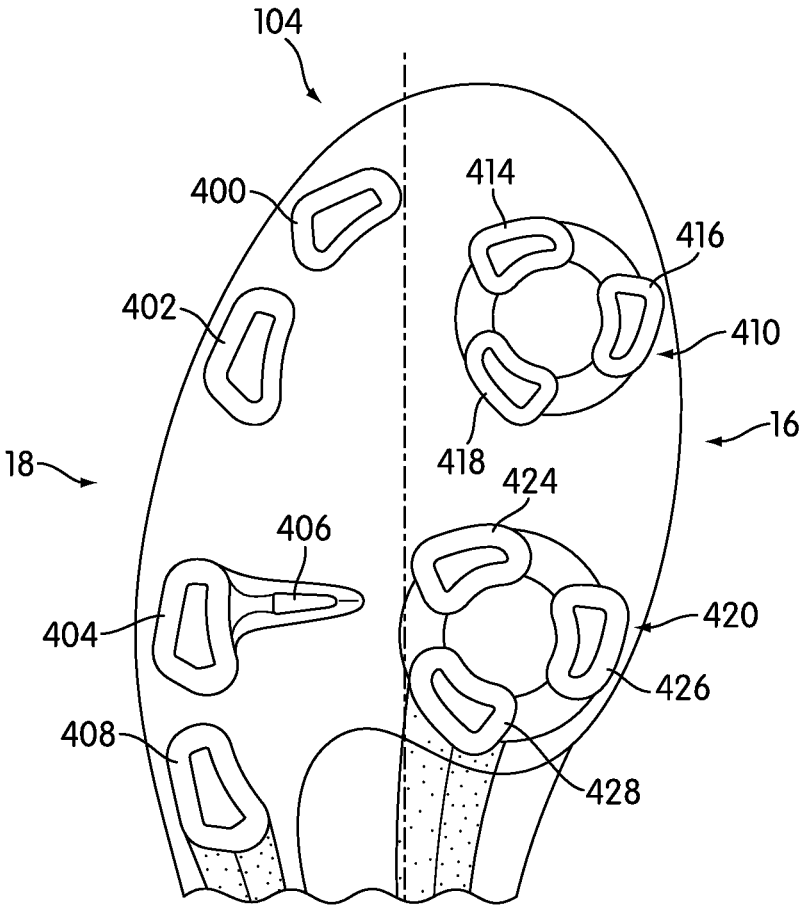
FIG. 11 is a schematic view of a forefoot region of a sole structure including an exemplary embodiment of a traction element arrangement.

FIGS. 10 and 11 illustrate two exemplary embodiments of a traction element arrangement for a sole structure configured to assist a wearer with rotational and/or transverse movements. In some embodiments, the arrangement of traction elements disposed on lateral side 18 and/or medial side 16 may be varied. In an exemplary embodiment, forefoot region 10 may include a number of traction elements of a first group disposed along lateral side 18 and a number of traction elements of a second group disposed along medial side 16. In the embodiments shown in FIGS. 10 and 11, four traction elements are disposed along lateral side 18 and two traction elements are disposed along medial side 16. In other embodiments, more or less traction elements may be disposed along each of lateral side 18 and medial side 16. In addition, in some embodiments, a secondary stud may be disposed between traction elements associated with lateral side 18 and medial side 16.

In an exemplary embodiment, the relative arrangement of traction elements disposed on medial side 16 may further be varied to provide different characteristics to a sole structure of article 100. In one embodiment, the location of each individual stud or projection associated with one or more medial rotational traction elements may be varied. Referring to FIGS. 10 and 11, in the illustrated embodiments, medial side 16 may be associated with an outside nearest to the peripheral edge of sole structure 604 and an inside closer to lateral side 18 than the outside of medial side 16. While in the illustrated embodiments, traction elements associated with first group of traction elements 108 and/or first group of traction elements 608 and second group of traction elements 110 and/or second group of traction elements 610, discussed above, are shown, it should be understood that any type of traction element may be used, including combinations of various types of traction elements associated with first group of traction elements 108 and/or second group of traction elements 110, as well as other types and/or shapes.

In some embodiments, a traction element arrangement may include an approximately equal number of traction elements disposed along lateral side 18 and along the outside of medial side 16 and a smaller number of traction elements disposed along the inside of medial side 16. In one embodiment, the traction element arrangement associated with forefoot region 10 may include four lateral traction elements, two inside medial traction elements, and four outside medial traction elements. FIG. 10 illustrates an exemplary embodiment of sole structure 604 with this traction element arrangement. In this embodiment, four traction elements are disposed along lateral side 18, including first lateral cleat 700, second lateral cleat 702, third lateral cleat 704, and fourth lateral cleat 708, and two medial rotational traction elements are disposed on medial side 16, including first medial rotational cleat 710 and second medial rotational cleat 720. In addition, each of first medial rotational cleat 710 and second medial rotational cleat 720 are further configured so that individual stud elements associated with first medial rotational cleat 710 and/or second medial rotational cleat 720 are aligned with either the outside of medial side 16 or the inside of medial side 16.

Specifically as shown in FIG. 10, two stud elements, second stud element 716 and second stud element 726, are disposed along the inside of medial side 16, closer to lateral side 18, and four stud elements, first stud element 714, third stud element 718, first stud element 724, and third stud element 728, are disposed along the outside of medial side 16, closer to the peripheral edge of sole structure 604. With this arrangement, an approximately equal number of traction elements may be disposed near the peripheral edge of sole structure 604 on lateral side 18 and medial side 16. In some embodiments, sole structure 604 may also include an optional secondary stud 706 disposed between traction elements on lateral side 18 and traction elements disposed on the inside of medial side 16.

In some embodiments, a different traction element arrangement may be provided on a sole structure that is configured for more aggressive transverse movements. In some embodiments, a traction element arrangement may include an approximately equal number of traction elements disposed along lateral side 18 and along the inside of medial side 16 and a smaller number of traction elements disposed along the outside of medial side 16. With this arrangement, the smaller number of traction elements disposed along the outside of medial side 16 may assist a wearer with quicker transverse foot movements. In one embodiment, the traction element arrangement associated with forefoot region 10 may include four lateral traction elements, four inside medial traction elements, and two outside medial traction elements. FIG. 11 illustrates an exemplary embodiment of sole structure 104 with this traction element arrangement. In this embodiment, four traction elements are disposed along lateral side 18, including first lateral cleat 400, second lateral cleat 402, third lateral cleat 404, and fourth lateral cleat 408, and two medial rotational traction elements are disposed on medial side 16, including first medial rotational cleat 410 and second medial rotational cleat 420. In addition, each of first medial rotational cleat 410 and second medial rotational cleat 420 are further configured so that individual stud elements associated with first medial rotational cleat 410 and/or second medial rotational cleat 420 are aligned with either the outside of medial side 16 or the inside of medial side 16.

Specifically as shown in FIG. 11, four stud elements, first stud element 414, third stud element 418, first stud element 424, and third stud element 428, are disposed along the inside of medial side 16, closer to lateral side 18, and two stud elements, second stud element 416 and second stud element 426, are disposed along the outside of medial side 16, closer to the peripheral edge of sole structure 104. With this arrangement, an unequal number of traction elements may be disposed near the peripheral edge of sole structure 104 on lateral side 18 and medial side 16. In some embodiments, sole structure 104 may also include an optional secondary stud 406 disposed between traction elements on lateral side 18 and traction elements disposed on the inside of medial side 16.

Figure 12:
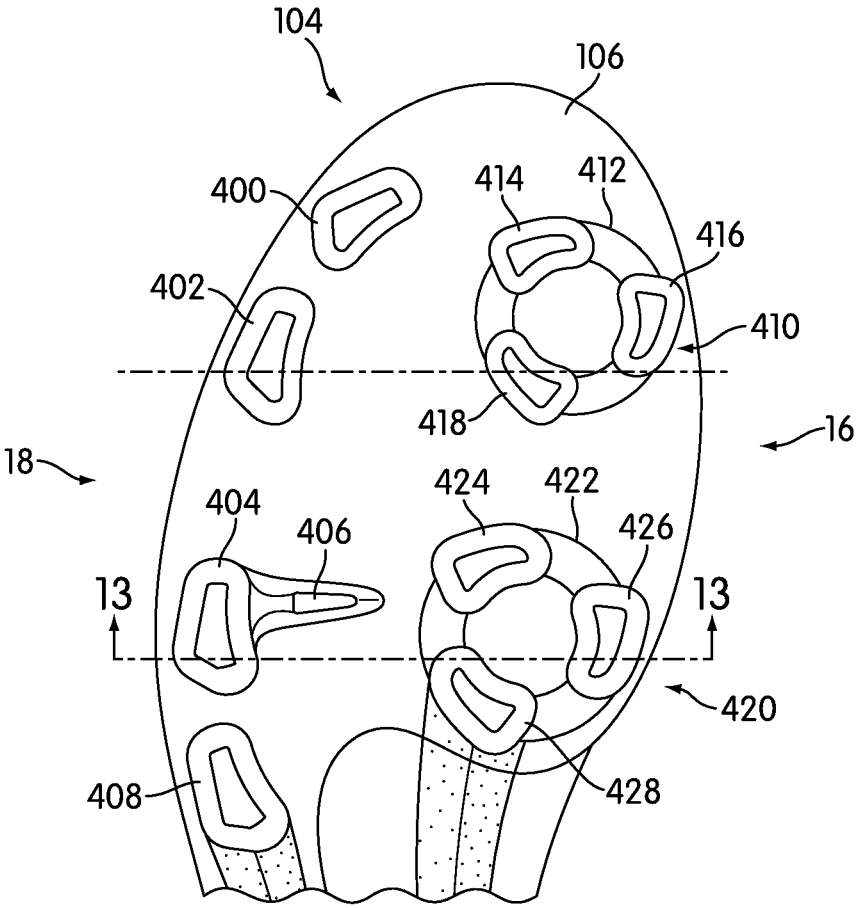
FIG. 12 is a schematic view of a forefoot region of a sole structure including an exemplary embodiment of a traction element arrangement.

In some embodiments, the arrangement of traction elements on a sole structure of article 100 may be configured to provide stability to a foot of a wearer. In an exemplary embodiment, traction elements disposed on lateral side 18 and traction elements disposed on medial side 16 may be aligned so that article 100 is supported across a lateral direction. Referring now to FIG. 12, a schematic view of forefoot region 10 of sole structure 104 including an exemplary embodiment of a traction element arrangement configured to provide lateral stability is illustrated. In an exemplary embodiment, one or more projections associated with second group of traction elements 110 on medial side 16, including first medial rotational cleat 410 and/or second medial rotational cleat 420, may be aligned across a lateral direction with one or more traction elements associated with first group of traction elements 108 on lateral side 18, including first lateral cleat 400, second lateral cleat 402, third lateral cleat 404, and/or fourth lateral cleat 408. In this embodiment, second lateral cleat 402 may be aligned across a lateral direction with third stud element 418 of first medial rotational cleat 410. Similarly, third lateral cleat 404 may be aligned across a lateral direction with second stud element 426 of second medial rotational cleat 420. With this arrangement, traction elements on each of lateral side 18 and medial side 16 may provide support and/or stability across a lateral direction of article 100. In other embodiments, additional traction elements on lateral side 18 and medial side 16 may be aligned across a lateral direction of sole structure 104 to provide lateral support and/or stability to a wearer of article 100.

Figure 13:
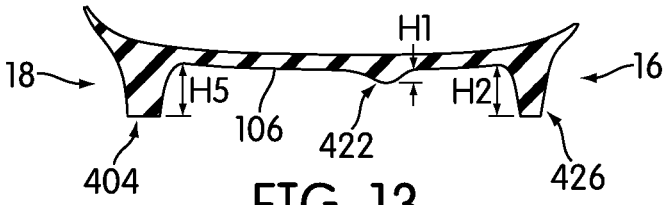
FIG. 13 is a cross-sectional view of a forefoot region of a sole structure including an exemplary embodiment of a traction element arrangement.

FIG. 13 illustrates a cross-sectional view of FIG. 12 showing alignment of traction elements on lateral side 18 and medial side 16. In this embodiment, third lateral cleat 404 and second stud element 426 of second medial rotational cleat 420 are aligned across a lateral direction. In some embodiments, the height of aligned traction elements may be configured to assist with providing stability and/or support. In an exemplary embodiment, the heights of laterally aligned traction elements may be substantially similar. In this embodiment, second stud element 426 may be associated with second height H2, as discussed above. Third lateral cleat 404 may be associated with a fifth height H5. In one embodiment, fifth height H5 of third lateral cleat 404 may be substantially similar to second height H2. With this arrangement, the substantially similar heights of the laterally aligned traction elements may provide an approximately even or level plane for a foot of a wearer relative to a ground surface. In addition, raised ring 422 associated with first height H1, as discussed above, is shown in cross-section in FIG. 13. In other embodiments, however, first height H1 may be closer to second height H2 and/or fifth height H5.

In other embodiments, the heights of laterally aligned traction elements may be different. In an exemplary embodiment, second height H2 of second stud element 426 may be smaller than fifth height H5 of third lateral cleat 404. With this arrangement, sole structure 104 may be configured to tilt or lean slightly inwards towards medial side 16. In different embodiments, the heights may be selected so as to increase or decrease the inward lean, or to provide a lean in the opposite direction towards lateral side 18.

In some embodiments, additional features may be added to traction elements and/or a sole structure to assist article 100 with interacting with a ground surface. In some cases, additional features may assist with one or more of ground penetration, traction on ground-engaging faces of traction elements, traction on portions of a sole structure not provided with traction elements, traction on different types of ground surfaces, as well as assisting with transverse and/or rotational movement. FIGS. 14 through 25 illustrate various embodiments of additional features that may be included on traction elements and/or a sole structure.

Figure 14:
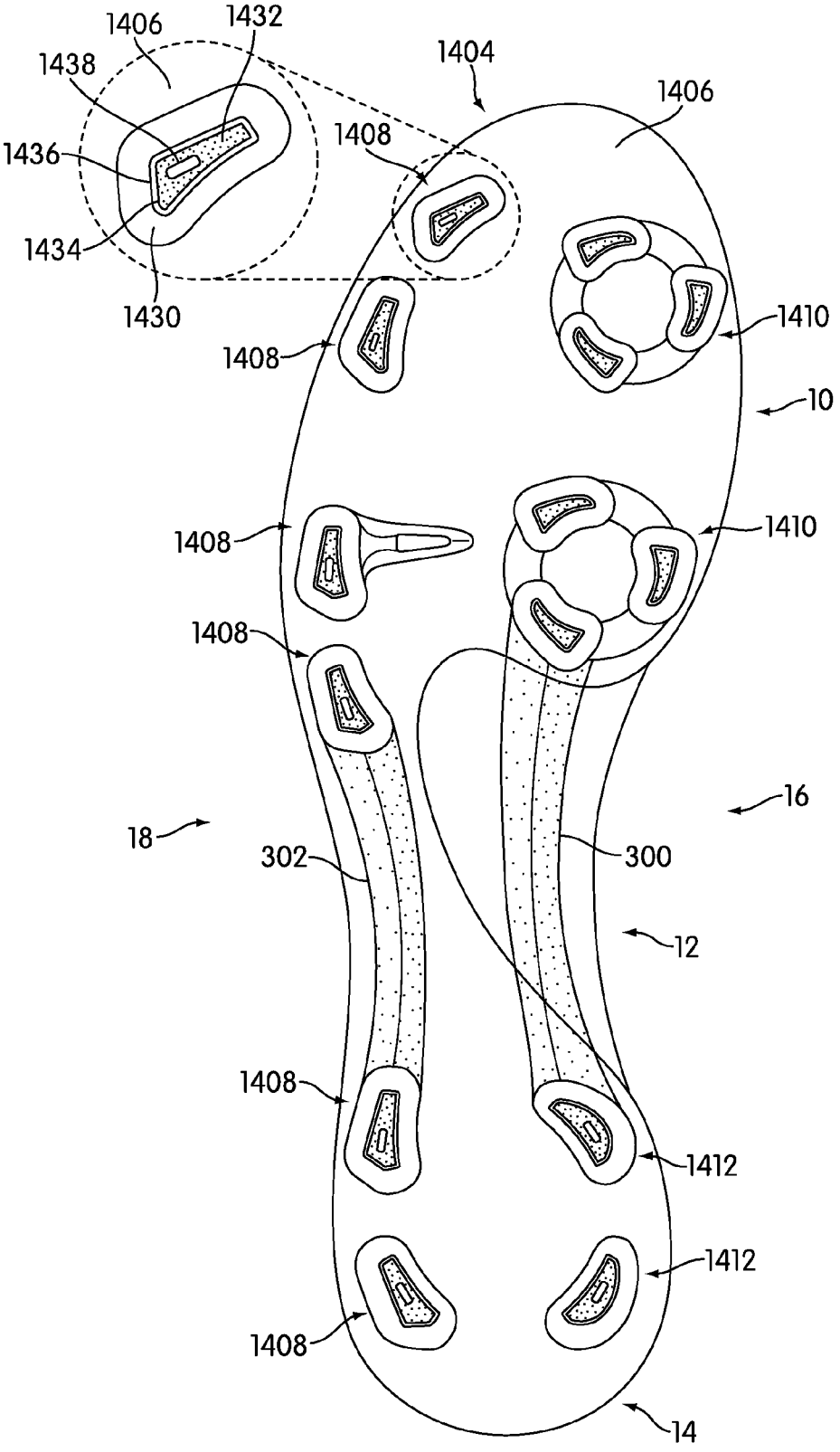
FIG. 14 is a top view of an alternate embodiment of a traction element arrangement including platform members.

FIG. 14 is a top view of an alternate embodiment of a traction element arrangement that includes additional features on the traction elements. In an exemplary embodiment, traction elements may include raised platform members on ground-engaging faces. In this embodiment, the traction element arrangement on sole structure 1404 may be similar to the traction element arrangement on sole structure 104, discussed above in reference to FIG. 3. The traction elements associated with the arrangement on sole structure 1404 may additionally be provided with raised platform members on ground-engaging faces. As shown in FIG. 14, the traction element arrangement includes a first group of traction elements 1408 and second group of traction elements 1410 with raised platform members. In this embodiment, the arrangement of first group of traction elements 1408 and second group of traction elements 1410 may be configured to assist a wearer of article 100 with rotational and/or transverse movement in a similar manner as discussed above in reference to first group of traction elements 108 and second group of traction elements 110.

In addition, in some embodiments, sole structure 1404 may include a third group of traction elements 1412 with raised platform members. In this embodiment, third group of traction elements 1412 may be arranged separately along heel region 14 of sole structure 1404, in a similar manner as third group of traction elements 112, discussed above. It should be understood that while in the embodiment illustrated in FIG. 14 each of first group of traction elements 1408, second group of traction elements 1410, and third group of traction elements 1412 are provided with raised platform members, in other embodiments, not all traction elements may include raised platform members. In some cases, only some groups of traction elements, or individual traction elements within some groups, may be provided with raised platform members.

In addition, in some embodiments, sole structure 1404 may include one or more additional components configured to provide support and/or stability to article 100, in a similar manner as described in reference to sole structure 104. In an exemplary embodiment, sole structure 1404 may include one or more support ribs, including medial rib 300 and/or lateral rib 302, as described above. In addition, in some embodiments, one or more of medial rib 300 and lateral rib 302 are optional and may be omitted.

A close-up view illustrating an embodiment of a raised platform member 1432 on a traction element is shown in FIG. 14. Raised platform cleat 1430 may be representative of a traction element with a raised platform member. In this embodiment, raised platform member 1432 may have a generally similar shape as raised platform cleat 1430. As shown in this embodiment, a perimeter 1434 of raised platform member 1432 is inset by a small amount relative to a perimeter 1436 of raised platform cleat 1430. In other embodiments, the inset amount between perimeter 1434 and perimeter 1436 may be varied to increase or decrease the surface area of raised platform member 1432 relative to the ground-engaging face of raised platform cleat 1430. In addition, in other embodiments, the shape of raised platform member 1432 may be different and need not have a generally similar shape as the shape of the traction element on which it is disposed.

In some embodiments, raised platform member 1432 may be slightly raised above the ground-engaging face of raised platform cleat 1430. In some cases, raised platform member 1432 may be from 0.1 mm to 1 mm above the ground-engaging face of raised platform cleat 1430. In other cases, raised platform member 1432 may be more or less above the ground-engaging face of raised platform cleat 1430. In addition, in still other cases, raised platform member 1432 may be a textured or roughed surface on the ground-engaging face of raised platform cleat 1430. With this arrangement, raised platform member 1432 may be configured to assist with penetrating a ground surface. The smaller and/or narrower surface area of raised platform member 1432 engages the ground surface first, thereby penetrating the ground surface and assisting raised platform cleat 1430 with traction.

In addition, in some embodiments, raised platform member 1432 may further include a hollow 1438. In an exemplary embodiment, hollow 1438 may be a groove or depression between portions of raised platform member 1432. Hollow 1438 may provide additional traction on a ground surface and/or may serve to move water or other material out from under the cleat member when article 100 is worn. In other cases, hollow 14385 may be a venting hole made during the manufacturing process of producing sole structure 1404 and/or traction elements.

In this embodiment, raised platform cleat 1430 is representative of a traction element with a raised platform member. One or more traction elements, including traction elements associated with first group of traction elements 1408 may include raised platform members. Also, projections and/or stud elements associated with medial rotational traction elements of second group of traction elements 1410 may have a substantially similar structure of raised platform members. Similarly, traction elements associated with third group of traction elements 1412 may have a substantially similar structure of raised platform members.

Figure 15:
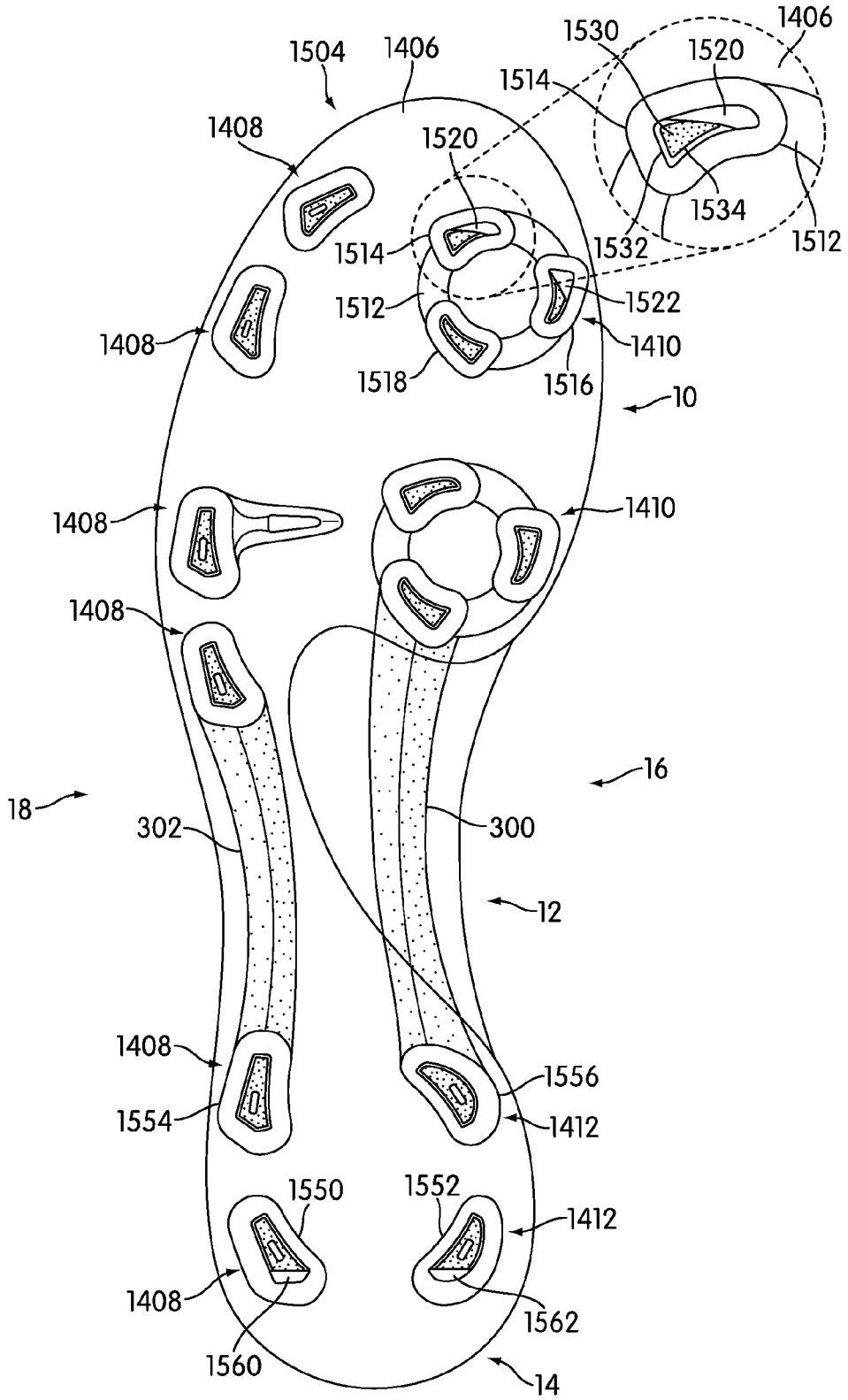
FIG. 15 is a top view of an alternate embodiment of a traction element arrangement including platform members and cut step features.

FIG. 15 is a top view of an alternate embodiment of a traction element arrangement that includes additional features on the traction elements. In an exemplary embodiment, traction elements may include one or more cut step features. In this embodiment, the traction element arrangement on sole structure 1504 may be similar to the traction element arrangement on sole structure 1404, discussed above in reference to FIG. 14 and/or sole structure 104, discussed above in reference to FIG. 3. The traction elements associated with the arrangement on sole structure 1504 may additionally be provided raised platform members on ground-engaging faces, as described above. As shown in FIG. 15, the traction element arrangement on sole structure 1504 includes first group of traction elements 1408, second group of traction elements 1410, and/or third group of traction elements 1412 with raised platform members. In this embodiment, one or more of the traction elements associated with first group of traction elements 1408, second group of traction elements 1410, and/or third group of traction elements 1412 may further include cut step features.

Referring now to FIG. 15, a cut step feature associated with one or more projections and/or stud elements of medial rotational traction element 1410 is shown. In this embodiment, medial rotational traction element 1410 may be substantially similar to first medial rotational cleat 410, discussed above, including a grouping of stud elements disposed on a raised ring 1512. In this embodiment, a first cut step 1520 is disposed on a first stud element 1514 and a second cut step 1522 is disposed on a second stud element 1516. Medial rotational traction element 1410 may include a third stud element 1518 on raised ring 1512 that does not include a cut step feature. In other embodiments, more or less projections and/or stud elements may be provided with cut step features.

Referring now to the close up view in FIG. 15, first cut step 1520 disposed on first stud element 1514 is illustrated. First cut step 1520 may be representative of a cut step feature disposed on any traction element. In this embodiment, first stud element 1514 may include a raised platform member 1530. In this embodiment, raised platform member 1530 may have a generally similar shape as first stud element 1514. As shown in this embodiment, a perimeter 1534 of raised platform member 1530 is inset by a small amount relative to a perimeter 1532 of first stud element 1514. Raised platform member 1530 may be substantially similar to raised platform member 1432, described above.

In this embodiment, first cut step 1520 is disposed across a portion of the ground-engaging face of first stud element 1514 and includes a portion of raised platform member 1530. In some embodiments, first cut step 1520 may be a face slightly below the ground-engaging face of first stud element 1514. With this arrangement, first cut step 1520 may be configured to assist with a first step in a transverse direction. The smaller height of first cut step 1520 on first stud element 1514 prevents first stud element 1514 from contacting the ground surface when making a movement in a transverse direction and leading with medial side 16 of forefoot region 10 of article 100.

Additional cut step features disposed on one or more traction elements on sole structure 1504 may be similar to first cut step 1520. In this embodiment, second cut step 1522 is disposed on second stud element 1516 of medial rotational traction element 1410. In some embodiments, cut step features may also be disposed on one or more traction elements associated with first group of traction elements 1408 and/or third group of traction elements 1412. In this embodiment, a first stepped heel cleat 1550 disposed on lateral side 18 of heel region 14 may include a first heel cut step 1560. Similarly, a second stepped heel cleat 1552 disposed on medial side 16 of heel region 14 may include a second heel cut step 1562. In this embodiment, first stepped heel cleat 1550 may be associated with first group of traction elements 1408 and second stepped heel cleat 1552 may be associated with third group of traction elements 1412. However, in other embodiments, traction elements with cut step features may be associated with any type of traction element.

In some embodiments, the traction elements disposed closest to the rearward periphery of heel region 14 may include cut step features, while traction elements disposed in a forwards direction towards midfoot region 12 may not include cut step features. In this embodiment, first stepped heel cleat 1550 includes first heel cut step 1560 and second stepped heel cleat 1552 includes second heel cut step 1562. However, a first heel cleat 1554 disposed above first heel cut step 1560 on lateral side 18 and a second heel cleat 1556 disposed above second stepped heel cleat 1552 on medial side 16 do not include cut step features. With this arrangement, first stepped heel cleat 1550 and/or second stepped heel cleat 1552 may be configured to allow less penetration at the rear of sole structure 1504 to assist with movement of article 100.

Figure 16:
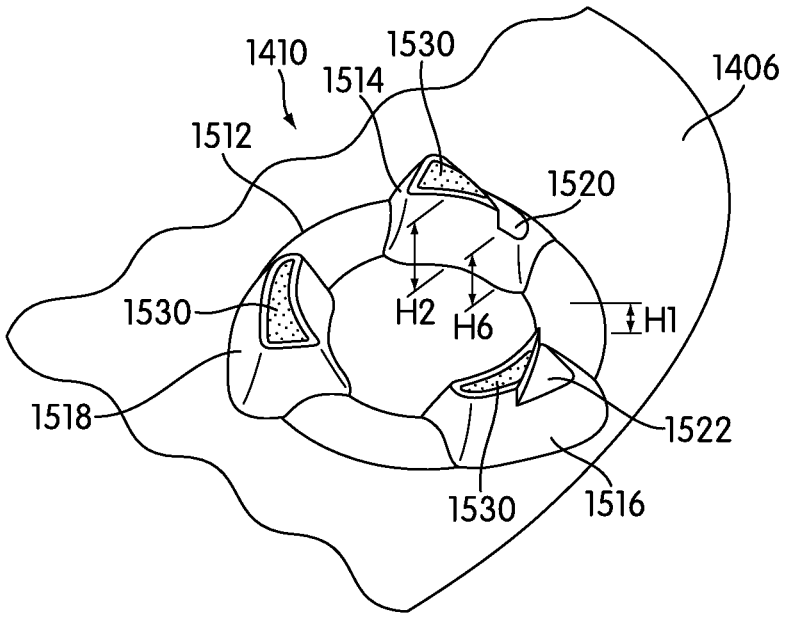
FIG. 16 is an enlarged view of an alternate embodiment of a medial rotational traction element with cut step features.

Referring now to FIG. 16, an enlarged view of medial rotational traction element 1410 including a stud element with cut step features is illustrated. In this embodiment, medial rotational traction element 1410 includes first stud element 1514, second stud element 1516 and third stud element 1518 disposed on raised ring 1512 above bottom surface 1406 of sole structure 1504, as described above. In this embodiment, medial rotational traction element 1410 may be substantially similar to first medial rotational cleat 410, discussed above, including a grouping of stud elements disposed on a raised ring 1512. In this embodiment, first cut step 1520 is disposed on first stud element 1514 and second cut step 1522 is disposed on second stud element 1516. In this embodiment, medial rotational traction element 1410 may include third stud element 1518 on raised ring 1512 that does not include a cut step feature.

In an exemplary embodiment, cut step features disposed on projections and/or stud elements may lower a portion of the ground-engaging face closer to bottom surface 1406 of sole structure 1504. As shown in FIG. 16, first stud element 1514 may be associated with second height H2, discussed above. Similarly, each of second stud element 1516 and/or third stud element 1518 may also be associated with second height H2, or different heights, as discussed above in reference to first medial rotational cleat 410. In addition, raised ring 1512 may be associated with first height H1, as discussed above in reference to raised ring 412. In this embodiment, first cut step 1520 may be associated with a sixth height H6. In some cases, sixth height H6 of first cut step 1520 may be configured so that the surface of first cut step 1520 is from 0.5 mm to 1.5 mm below the ground-engaging face of first stud element 1514. In other cases, first cut step 1520 may be configured with a height that is more or less below the ground-engaging face of first stud element 1514.

In some embodiments, second cut step 1522 may be associated with a substantially similar height as sixth height H6 of first cut step 1522. In other embodiments, the heights of first cut step 1520 and second cut step 1522 may vary. In one embodiment, cut step features on a stud element disposed closest to medial side 16 may have a smaller height from bottom surface 1406 than cut step features disposed on stud elements disposed farther from medial side 16. In still other embodiments, additional cut step features disposed on other stud elements and/or traction elements may have similar or varied heights.

Figure 17:
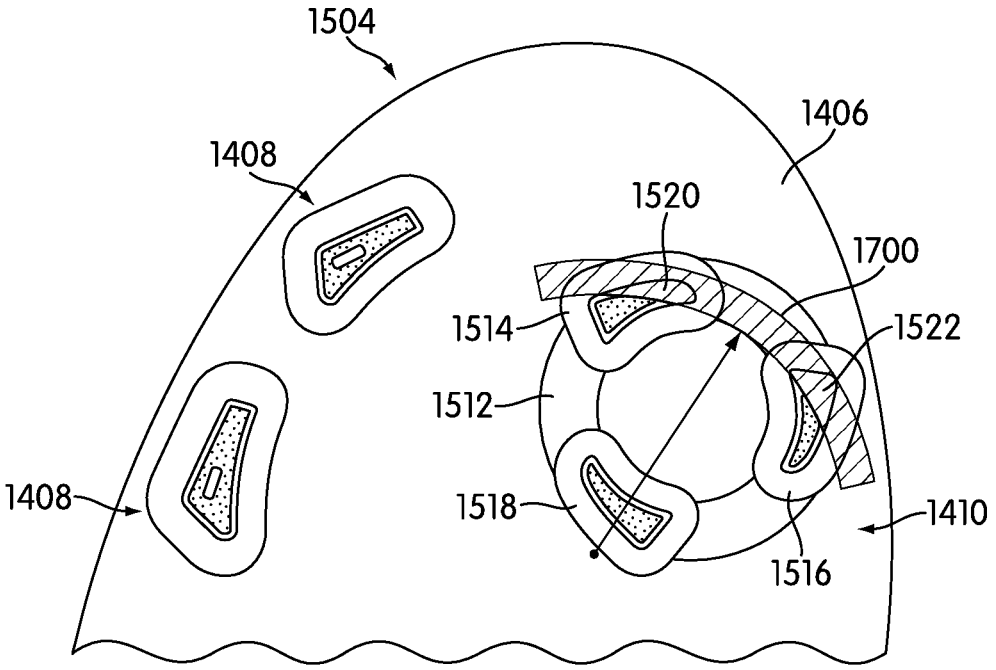
FIG. 17 is a schematic view of a forefoot region of a sole structure including an alternate embodiment of a traction element arrangement with cut step features.

In some embodiments, the alignment of cut step features on one or more projections and/or stud elements may vary. Referring now to FIG. 17, in an exemplary embodiment, the cut step features associated with first cut step 1520 and second cut step 1522 may be aligned with a generally arc-shaped or radial orientation 1700 across first stud element 1514 and second stud element 1516. In this embodiment, radial orientation 1700 may be configured so that a tangent of radial orientation 1700 is generally aligned in a direction of a first step of the foot of a wearer. With this arrangement, the cut step features of first cut step 1520 and second cut step 1522 with radial orientation 1700 may assist a wearer with transverse and/or rotational movement.

In addition, in some embodiments, more or less surface area of the ground-engaging face of the projection and/or stud element may be configured to include a cut step feature. In this embodiment, first cut step 1520 is configured to include a larger proportion of the surface area of the ground-engaging face of first stud element 1514 compared with the surface area of second cut step 1522 relative to the ground-engaging face of second stud element 1516. In other embodiments, cut step features on projections, stud elements, and/or traction elements may be varied to include similar or different proportions of the surface area of the ground-engaging face of the respective projection, stud element or traction element.

Figure 18:
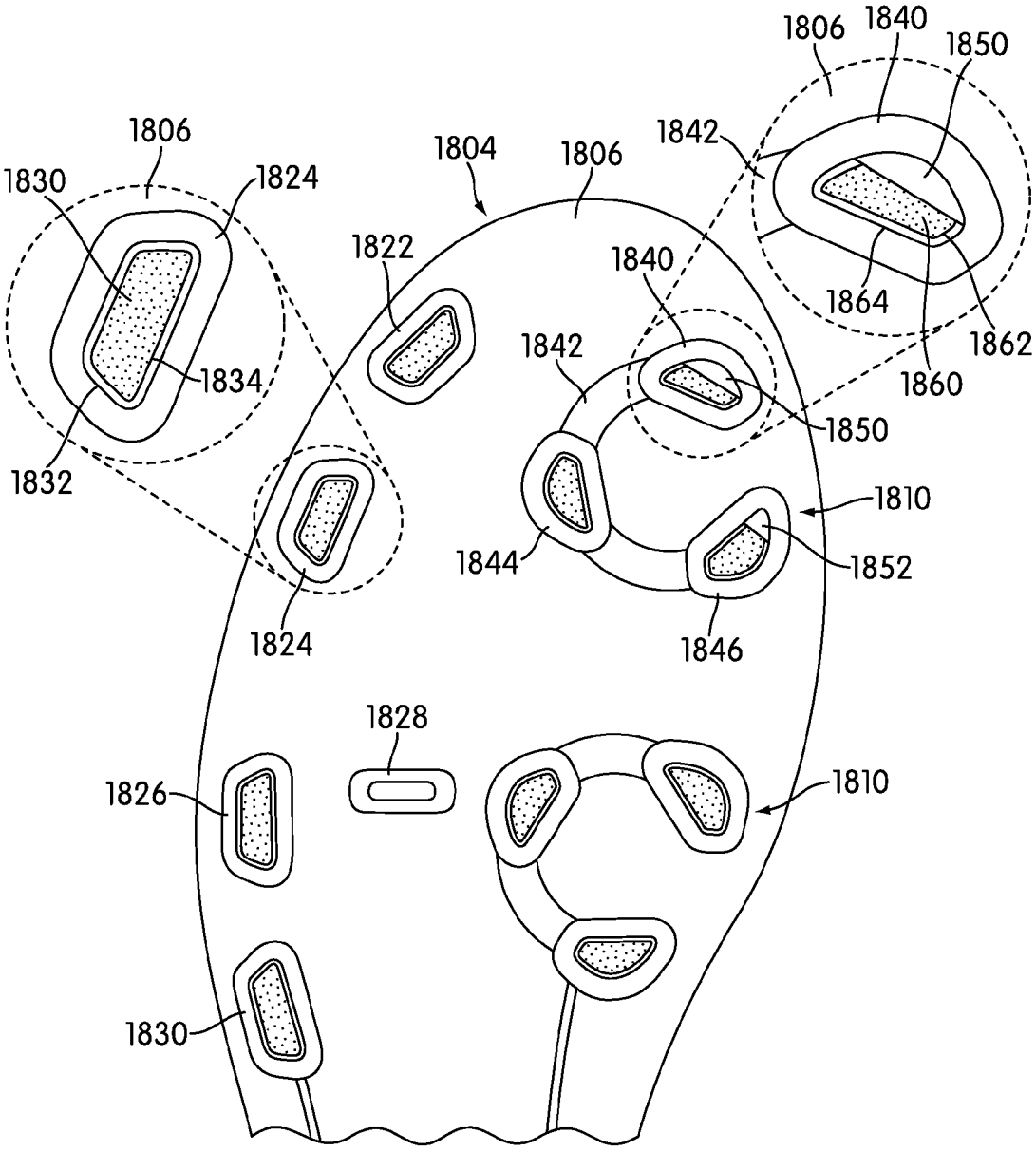
FIG. 18 is a top view of a forefoot region of a sole structure including an alternate embodiment of a traction element arrangement including platform members and cut step features.
Figure 19:
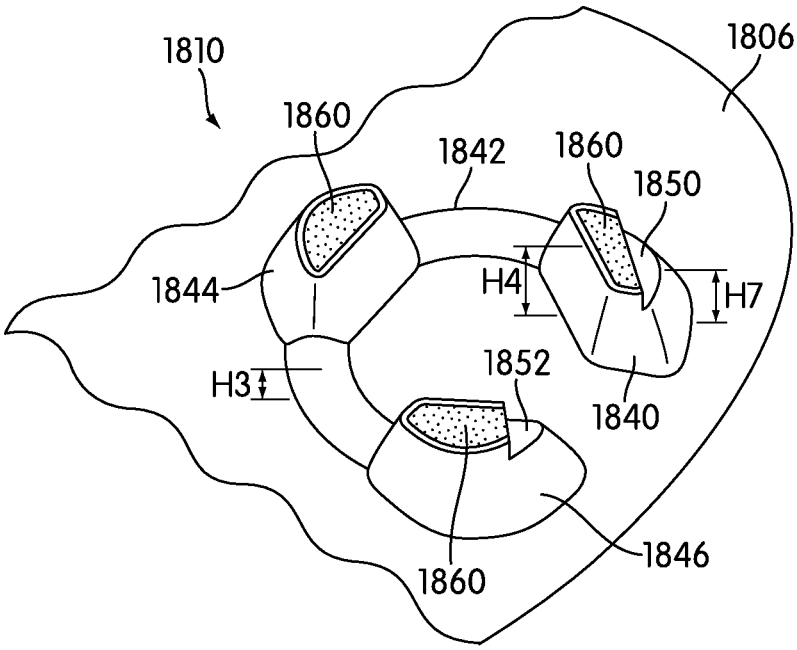
FIG. 19 is an enlarged view of an alternate embodiment of a medial rotational traction element with cut step features.
Figure 20:
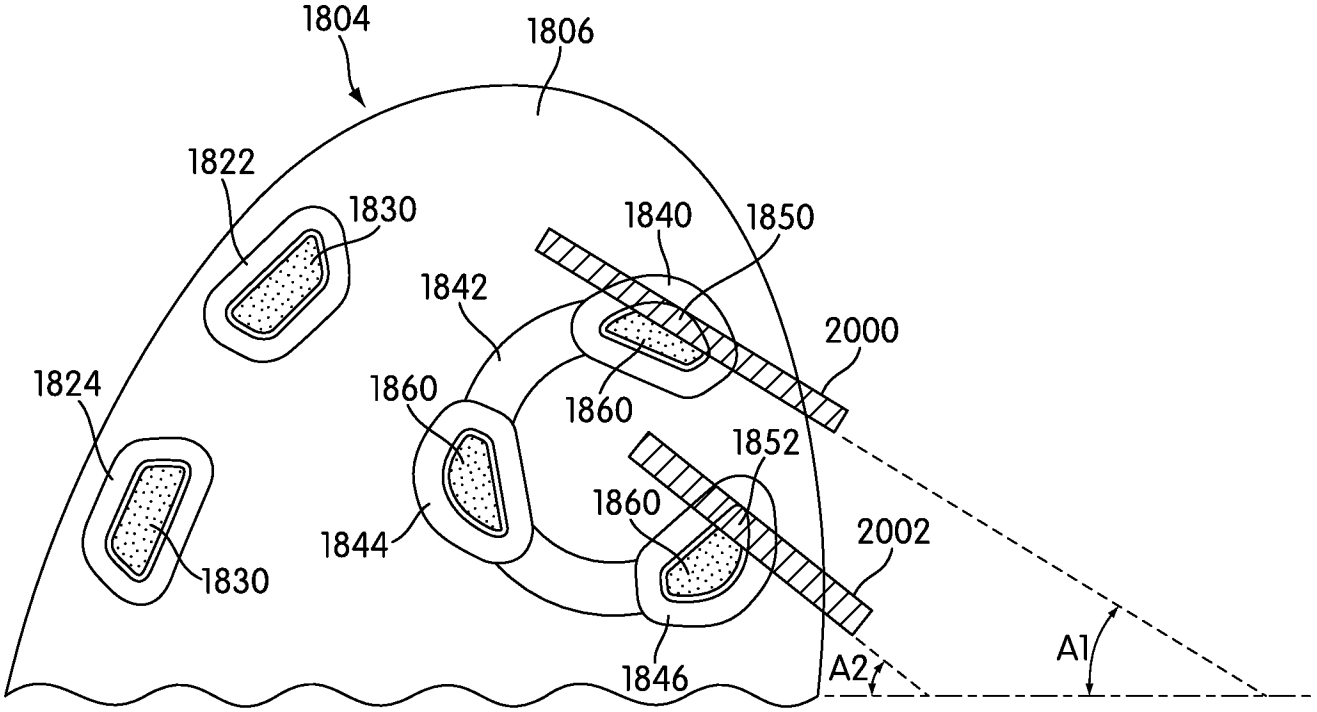
FIG. 20 is a schematic view of a forefoot region of a sole structure including an alternate embodiment of a traction element arrangement with cut step features.

FIGS. 18 through 20 illustrate an alternate embodiment of cut step features disposed on a medial rotational traction element. Referring now to FIG. 18, a top view of forefoot region 10 of a sole structure 1804 including an alternate embodiment of a traction element arrangement including platform members and cut step features is illustrated. In this embodiment, the traction element arrangement on sole structure 1804 may be similar to the traction element arrangement on sole structure 604, discussed above in reference to FIGS. 6 and 7. The traction elements associated with the arrangement on sole structure 1804 may additionally be provided with raised platform members 1830 on ground-engaging faces. As shown in FIG. 18, the traction element arrangement includes a first group of traction elements with raised platform members, including a first lateral cleat 1822, a second lateral cleat 1824, a third lateral cleat 1826, and a fourth lateral cleat 1830, and a second group of traction elements with raised platform members, including medial rotational traction elements

1810. In addition, sole structure 1804 may also include a secondary stud 1828 disposed adjacent to third lateral cleat 1826. Secondary stud 1828 may be substantially similar to secondary stud 706, discussed above.

In this embodiment, the arrangement of the first group of traction elements and the second group of traction elements 1810 may be configured to assist a wearer of article 100 with rotational and/or transverse movement in a similar manner as discussed above in reference to first group of traction elements 608 and second group of traction elements 610, discussed above. In addition, in different embodiments, sole structure 1804 may include groups of traction elements, or individual traction elements within some groups, with or without raised platform members.

A close-up view illustrating an embodiment of a raised platform member 1830 on a traction element is shown in FIG. 18. Raised platform member 1830 may be representative of a raised platform member disposed on any projection, stud element, and/or traction element. In this embodiment, raised platform member 1830 is shown disposed on second lateral cleat 1824. In an exemplary embodiment, raised platform member 1830 may have a generally similar shape as second lateral cleat 1824. As shown in this embodiment, a perimeter 1834 of raised platform member 1830 is inset by a small amount relative to a perimeter 1832 of second lateral cleat 1824. In other embodiments, the inset amount between perimeter 1834 and perimeter 1832 may be varied to increase or decrease the surface area of raised platform member 1830 relative to the ground-engaging face of second lateral cleat 1824. In addition, in other embodiments, the shape of raised platform member 1830 may be different and need not have a generally similar shape as the shape of the traction element on which it is disposed.

In some embodiments, an alternate cut step feature associated with one or more projections and/or stud elements of medial rotational traction element 1810 may be provided. In an exemplary embodiment, the cut step feature may be generally straight, in contrast to the cut step feature illustrated in FIGS. 15 through 17, which is generally arc-shaped. In this embodiment, medial rotational traction element 1810 may be substantially similar to first medial rotational cleat 710, discussed above, including a grouping of stud elements disposed on a raised ring 1842. In this embodiment, a first straight cut step 1850 is disposed on a first stud element 1840 and a second straight cut step 1852 is disposed on a second stud element 1846. Medial rotational traction element 1810 may include a third stud element 1844 on raised ring 1842 that does not include a cut step feature. In other embodiments, more or less projections and/or stud elements may be provided with cut step features.

Referring now to the close up view of medial rotational traction element 1810 in FIG. 18, first straight cut step 1850 disposed on first stud element 1840 is illustrated. First straight cut step 1850 may be representative of a straight cut step feature disposed on any traction element. In this embodiment, first stud element 1840 may include a raised platform member 1860. In this embodiment, raised platform member 1860 may have a generally similar shape as first stud element 1840. As shown in this embodiment, a perimeter 1862 of raised platform member 1860 is inset by a small amount relative to a perimeter 1864 of first stud element 1840. Raised platform member 1860 may be substantially similar to any raised platform member described above.

In this embodiment, first straight cut step 1850 is disposed across a portion of the ground-engaging face of first stud element 1840 and includes a portion of raised platform member 1860. In some embodiments, first straight cut step 1850 may be a face slightly below the ground-engaging face of first stud element 1840. With this arrangement, first straight cut step 1850 may be configured to assist with a first step in a transverse direction. The smaller height of first straight cut step 1850 on first stud element 1840 prevents first stud element 1840 from contacting the ground surface when making a movement in a transverse direction and leading with medial side 16 of forefoot region 10 of article 100.

Additional cut step features disposed on one or more traction elements on sole structure 1804 may be similar to first straight cut step 1850. In this embodiment, second straight cut step 1852 is disposed on second stud element 1846 of medial rotational traction element 1810.

Referring now to FIG. 19, an enlarged view of medial rotational traction element 1810 including a stud element with straight cut step features is illustrated. In this embodiment, medial rotational traction element 1810 includes first stud element 1840, second stud element 1846 and third stud element 1844 disposed on raised ring 1842 above bottom surface 1806 of sole structure 1804, as described above. In this embodiment, medial rotational traction element 1810 may be substantially similar to first medial rotational cleat 710, discussed above, including a grouping of stud elements disposed on a raised ring 1842. In this embodiment, first straight cut step 1850 is disposed on first stud element 1840 and second straight cut step 1852 is disposed on second stud element 1846. In this embodiment, medial rotational traction element 1810 may include third stud element 1844 on raised ring 1842 that does not include a cut step feature.

In an exemplary embodiment, straight cut step features disposed on projections and/or stud elements may lower a portion of the ground-engaging face closer to bottom surface 1806 of sole structure 1804. As shown in FIG. 19, first stud element 1840 may be associated with fourth height H4, discussed above. Similarly, each of second stud element 1846 and/or third stud element 1844 may also be associated with fourth height H4, or different heights, as discussed above in reference to first medial rotational cleat 710. In addition, raised ring 1842 may be associated with third height H3, as discussed above in reference to raised ring 712. In this embodiment, first straight cut step 1850 may be associated with a seventh height H7. In some cases, seventh height H7 of first straight cut step 1850 may be configured so that the surface of first straight cut step 1850 is from 0.5 mm to 1.5 mm below the ground-engaging face of first stud element 1840. In other cases, first straight cut step 1850 may be configured with a height that is more or less below the ground-engaging face of first stud element 1840. In addition, as described above with reference to the cut step features illustrated in FIGS. 15 and 16, the heights of straight cut step features may similarly vary.

Referring now to FIG. 20, in an alternate embodiment, the cut step features associated with first straight cut step 1850 and second straight cut step 1852 may have generally skewed relative alignments across first stud element 1840 and second stud element 1846. In this embodiment, first straight orientation 2000 associated with first straight cut step 1850 may be configured with an alignment that is a first angle A1 offset from a lateral direction. Similarly, second straight orientation 2002 associated with second straight cut step 1852 may be configured with an alignment that is a second angle A2 offset from a lateral direction. In some embodiments, first angle A1 and second angle A2 may be different angles. With this arrangement, first straight orientation 2000 may be skewed relative to second straight orientation 2002. In other embodiments, first angle A1 and second angle A2 may be substantially similar so that first straight orientation 2000 and second straight orientation 2002 are approximately parallel.

In addition, in some embodiments, more or less surface area of the ground-engaging face of the projection and/or stud element may be configured to include a straight cut step feature. In this embodiment, first straight cut step 1850 is configured to include a substantially larger proportion of the surface area of the ground-engaging face of first stud element 1840 compared with the surface area of second straight cut step 1852 relative to the ground-engaging face of second stud element 1846. In other embodiments, cut step features on projections, stud elements, and/or traction elements may be varied to include similar or different proportions of the surface area of the ground-engaging face of the respective projection, stud element or traction element.

Figure 21:
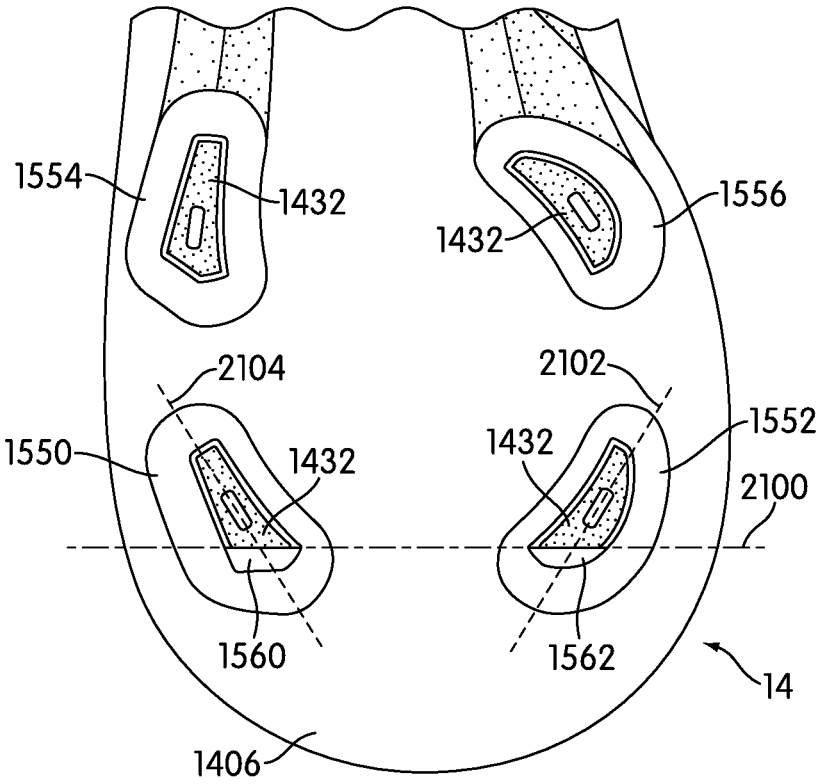
FIG. 21 is a schematic view of a heel region of a sole structure including an alternate embodiment of a traction element arrangement with cut step features.
Figure 22:
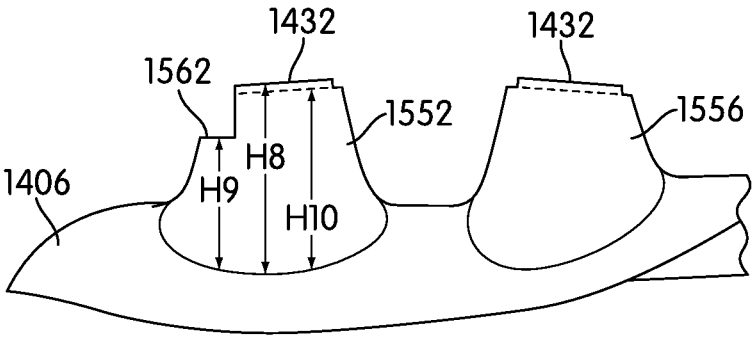
FIG. 22 is a longitudinal cross-section view of a heel region of a sole structure including an alternate embodiment of a traction element arrangement with cut step features.

FIGS. 21 and 22 illustrate an exemplary embodiment of an alignment of cut step features disposed on a traction element in heel region 14 of a sole structure. Referring now to FIG. 21, in an exemplary embodiment, first stepped heel cleat 1550 includes first heel cut step 1560 and second stepped heel cleat 1552 includes second heel cut step 1562, as described above in reference to FIG. 15. In this embodiment, traction elements disposed in heel region 14 may include platform members 1432. In other embodiments, however, platform members 1432 are optional and may be omitted.

As shown in FIG. 21, in an exemplary embodiment, cut step features may be generally aligned laterally across one or more traction elements. In this embodiment, first heel cut step 1560 and second heel cut step 1562 are aligned in a generally lateral direction 2100 across both of first stepped heel cleat 1550 and second stepped heel cleat 1552. In addition, the cut step feature associated with each of first stepped heel cleat 1550 and second stepped heel cleat 1552 may be aligned in direction 2100 while a major axis of each of the traction elements is aligned in different directions. In this embodiment, a major axis 2102 of second stepped heel cleat 1552 and a major axis 2104 of first stepped heel cleat 1550 may be aligned in different directions. The cut step features associated with first heel cut step 1560 and second heel cut step 1562, however, are aligned with the substantially same alignment along direction 2100. With this arrangement, the cut step features associated with the traction elements disposed in heel region 14 of sole structure 1504 may assist with planting of the heel of a foot of a wearer when shifting body weight back on the heel or rocking back on the heel. In addition, the cut step feature may also allow less penetration at the rear of sole structure 1504 to assist with movement of article 100.

FIG. 22 is longitudinal side view of the cut step features on traction elements disposed in heel region 14. In this embodiment, second stepped heel cleat 1552 may be associated with an eighth height H8 extending from bottom surface 1406 of sole structure 1504 to the top of raised platform member 1432. In an exemplary embodiment, eighth height H8 may be associated with a similar height as second height H2 and/or fourth height H4 associated with any of the traction elements described above. In some cases, eighth height H8 may be from 4 mm to 8 mm. In other cases, eighth height H8 may be from 6 mm to 10 mm. In still other cases, eighth height H8 may be smaller or larger. In this embodiment, second heel cut step 1562 may be associated with a ninth height H9. In some cases, ninth height H9 of second heel cut step 1562 may be configured so that the surface of second heel cut step 1562 is from 1.5 mm to 3 mm below the ground-engaging face of second stepped heel cleat 1552. In other cases, second heel cut step 1562 may be configured with a height that is more or less below the ground-engaging face of second stepped heel cleat 1552.

In addition, second stepped heel cleat 1552 may be associated with tenth height H10 extending from bottom surface 1406 of sole structure 1504 to the ground-engaging face of second stepped heel cleat 1552. In this embodiment, tenth height H10 does not include the height of raised platform member 1432. As described above, the height of raised platform member 1432 may vary.

Figure 23:
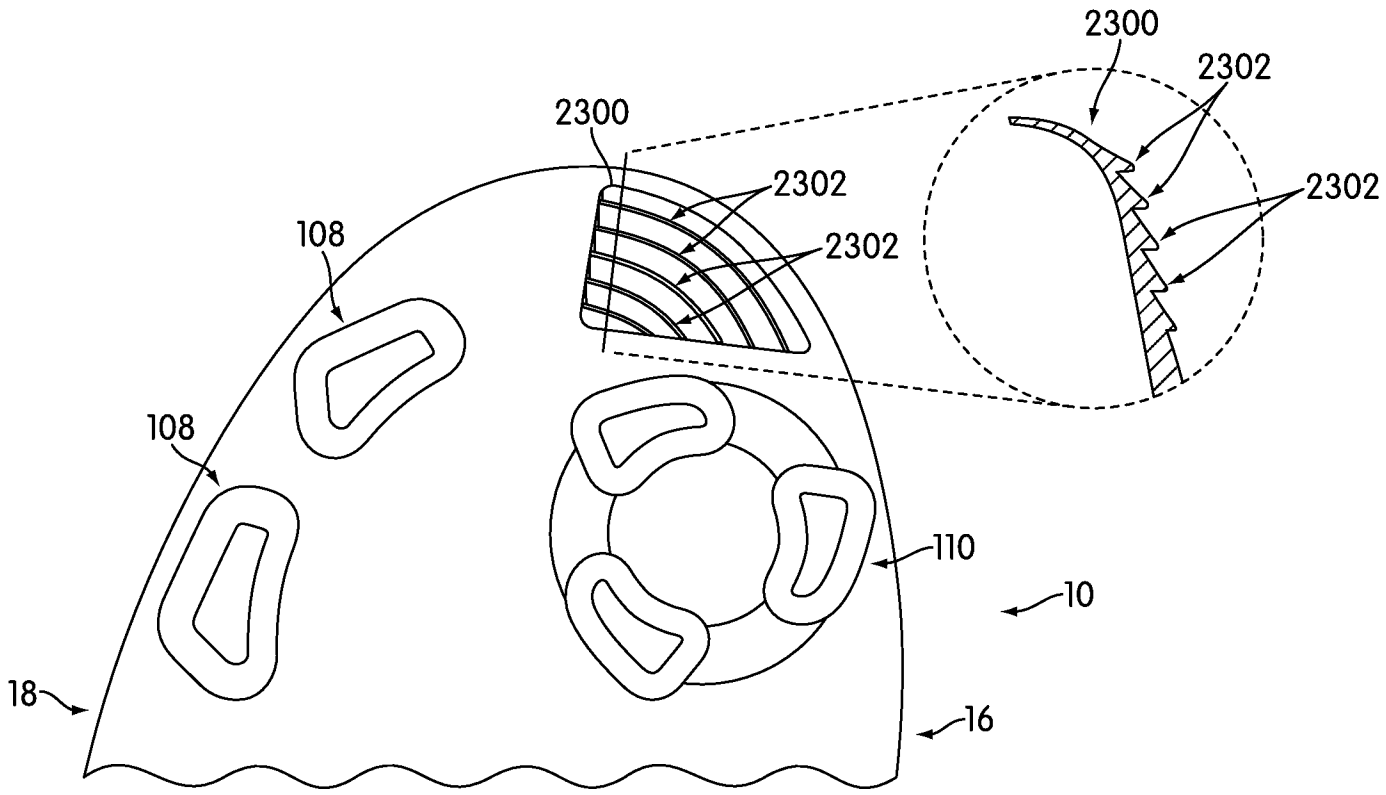
FIG. 23 is an enlarged view of an exemplary embodiment of a toe feature.
Figure 24:
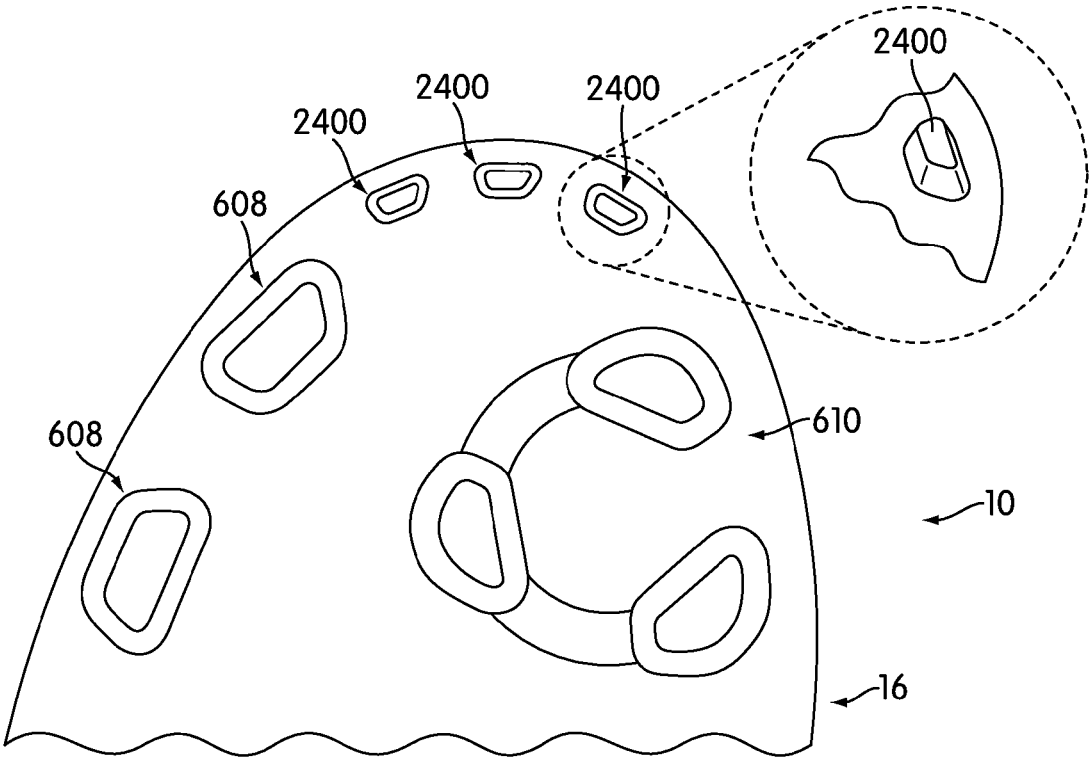
FIG. 24 is an enlarged view of an alternate embodiment of a toe feature.
Figure 25:
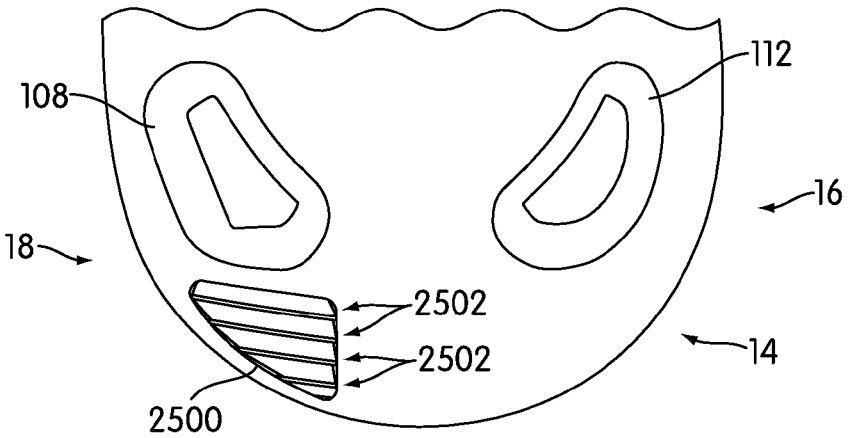
FIG. 25 is an enlarged view of an exemplary embodiment of a heel feature.

FIGS. 23 through 25 illustrate various additional features that may be provided on a sole structure in a toe portion of forefoot region 10 and/or a rear portion of heel region 14 to assist with providing traction with a ground surface or a ball. Referring now to FIG. 23, an exemplary embodiment of a toe feature 2300 is illustrated. In this embodiment, toe feature 2300 may be a plurality of toe fins 2302. In some embodiments, toe fins 2302 may be a series of concentric rings of fins or raised projections that extend out from a bottom surface of a sole structure. In an exemplary embodiment, the height of toe fins 2302 may vary. In some cases, toe fins 2302 may extend from 0.5 mm to 1.25 mm above the bottom surface of the sole structure. In other cases, toe fins 2302 may be smaller or larger. In one embodiment, the height of toe fins 2302 may be graduated from a larger nearest peripheral edge to smaller inwards closer to medial rotational traction element 110.

In some embodiments, using toe fins 2302 to provide additional traction may allow toe feature 2300 to assist with gripping a ball and/or to provide additional traction on a ground surface. In addition, in an exemplary embodiment, toe feature 2300 may be disposed along medial side 16 of the sole structure. With this arrangement, toe feature 2300 may be located in an area on article to assist a wearer with gripping a ball. In other embodiments, toe feature 2300 may extend to lateral side 18 and/or may be disposed only on lateral side 18.

FIG. 24 illustrates an enlarged view of an alternate embodiment of a toe feature 2400. In this embodiment, toe feature 2400 may be a plurality of toe studs. In one embodiment, toe studs associated with toe feature 2400 may be smaller relative to other traction elements disposed on the sole structure. In some cases, toe studs may have a height from 1 mm to 2 mm. In other cases, toe studs may be smaller. In addition, in other embodiments, toe studs are optional and may be omitted. As shown in FIG. 24, toe feature 2400 includes three toe studs disposed near a peripheral edge of forefoot region 10. In other embodiments, toe feature 2400 may include more or less toe studs. In this embodiment, toe feature 2400 is disposed approximately uniformly across portions of lateral side 18 and medial side 16. In other embodiments, however, toe feature 2400 may be disposed only on one side. With this arrangement, toe feature 2400 may provide additional traction on a ground surface and/or may assist with gripping a ball.

In some embodiments, a sole structure may also include one or more features disposed in heel region 14. Referring now to FIG. 25, an exemplary embodiment of a heel feature 2500 is illustrated. In one embodiment, heel feature 2500 may be substantially similar to toe feature 2300, described above. In this embodiment, heel feature 2500 may be a plurality of heel fins 2502. In some embodiments, heel fins 2502 may be a series of concentric rings of fins or raised projections that extend out from a bottom surface of a sole structure. In an exemplary embodiment, the height of heel fins 2502 may vary. In some cases, heel fins 2502 may extend from 0.5 mm to 1.25 mm above the bottom surface of the sole structure. In other cases, heel fins 2502 may be smaller or larger. In one embodiment, the height of toe fins 2502 may be graduated from a larger nearest peripheral edge to smaller inwards closer to traction element 108.

In some embodiments, using heel fins 2502 to provide additional traction may allow heel feature 2500 to assist with trapping a ball and/or to provide additional traction on a ground surface. In addition, in an exemplary embodiment, heel feature 2500 may be disposed along lateral side 18 of the sole structure. With this arrangement, heel feature 2500 may be located in an area on article to assist a wearer with trapping a ball. In other embodiments, heel feature 2500 may extend to medial side 16 and/or may be disposed only on medial side 16. In addition, in an exemplary embodiment, heel feature 2500 may be disposed on an opposite side of the sole structure from toe feature 2300. With this arrangement, if toe feature 2300 is disposed on medial side 16 of the sole structure, then heel feature 2500 is disposed on lateral side 18.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure including a partially rigid plate that extends across a substantial majority of a bottom surface of the sole structure, the sole structure having a forward edge, a rearward edge disposed opposite the forward edge, and a longitudinal axis extending through a center of the sole structure, including a center of the rearward edge and a center of the forward edge, and dividing the sole structure into a medial side and a lateral side;

a first group of traction elements disposed on the bottom surface;

a second group of traction elements integrally formed with the plate on the bottom surface;

the second group of traction elements comprising a plurality of medial rotational cleats including at least a first medial rotational cleat and a second medial rotational cleat, wherein the first medial rotational cleat is spaced entirely apart from the second medial rotational cleat;

each of the first medial rotational cleat and the second medial rotational cleat comprising:

a raised ring, the raised ring extending from the bottom surface of the sole structure;

a plurality of stud elements extending away from the bottom surface, wherein the plurality of stud elements are arranged along the raised ring of the respective medial rotational cleat in a generally circular grouping positioned around a center point of the respective medial rotational cleat, wherein each stud element includes:

a curved, concave, inner face oriented towards and curved towards the center point of the respective medial rotational cleat such that the plurality of stud elements define an inside portion of the medial rotational cleat, wherein the plate is exposed at the inside portion of the respective medial rotational cleat, and wherein the center point of the first medial rotational cleat is positioned closer to the forward edge of the sole structure than the center point of the second medial rotational cleat is positioned; and a curved outer face on a radially opposite side of the stud element from the curved, concave, inner face, and wherein the curved outer face is convex; and wherein the first group of traction elements are disposed on a lateral side of the sole structure and the second group of traction elements are disposed substantially on a medial side of the sole structure.

2. The article of footwear according to claim 1, wherein the plurality of medial rotational cleats are disposed in a forefoot region of the sole structure; and wherein the inside portion is disposed radially inward of the stud elements.

3. The article of footwear according to claim 2, wherein the first medial rotational cleat is disposed adjacent to the peripheral edge of the forefoot region and the second medial rotational cleat is disposed between the first medial rotational cleat and a midfoot region of the sole structure.

4. The article of footwear according to claim 1, wherein the raised ring and the plurality of stud elements form a closed circular shape.

5. The article of footwear according to claim 1, wherein the plurality of stud elements are connected by the raised ring to form an open c-shape.

6. The article of footwear according to claim 1, further comprising a third group of traction elements disposed in a heel region of the sole structure, the third group of traction elements having a different shape than the first group of traction elements and the second group of traction elements.

7. The article of footwear according to claim 1, wherein a rearwardmost stud element of the first medial rotational cleat is closer to the rearward edge than any other stud element of the plurality of stud elements of the first medial rotational cleat and wherein a forwardmost stud element of the second medial rotational cleat is closer to the forward edge than any other stud elements of the plurality of stud elements of the second medial rotational cleat, the rearwardmost stud element of the first medial rotational cleat being closer to the forward edge than the forwardmost stud element of the second medial rotational cleat.

8. The article of footwear according to claim 7, further comprising at least one secondary stud disposed between the first group of traction elements and the second group of traction elements and further comprising a traction element extending out from the bottom surface a first height less than a second height the secondary stud extends out from the bottom surface and connecting the secondary stud to at least one traction element associated with the first group of traction elements.

9. The article of footwear according to claim 7, further comprising at least one secondary stud disposed between the first group of traction elements and the second group of traction elements and wherein the secondary stud is disposed separately from any of the traction elements associated with the first group of traction elements and the second group of traction elements.

10. An article of footwear, comprising:

a sole structure including a bottom surface, the sole structure having a longitudinal axis extending through a center of the sole structure and dividing the sole structure into a lateral side and a medial side;

a first group of traction elements disposed on a lateral side of the bottom surface, and extending away from the bottom surface a first height;

a second group of traction elements molded with the sole structure on a medial side of the bottom surface, including a first medial rotational cleat and a second medial rotational cleat;

wherein the first group of traction elements has a different shape than the second group of traction elements and wherein the first group of traction elements are disposed on a lateral side of the sole structure and the second group of traction elements are disposed substantially on a medial side of the sole structure; and wherein the first medial rotational cleat is spaced entirely apart from the second medial rotational cleat, each of the first medial rotational cleat and the second medial rotational cleat comprising:

a raised ring, the raised ring extending from the bottom surface of the sole structure;

a plurality of stud elements extending away from the bottom surface a second height substantially similar to the first height, wherein the plurality of stud elements are arranged along the raised ring of the respective medial rotational cleat in a generally circular grouping positioned around a center point of the respective medial rotational cleat, and wherein each stud element includes:

a curved, concave inner face oriented towards and curved towards the center point of the respective medial rotational cleat such that the plurality of stud elements define an inside portion of the medial rotational cleat; and a curved outer face on a radially opposite side of the stud element from the curved, concave, inner face, and wherein the curved outer face is convex; and wherein the plate is exposed at the inside portion of the respective medial rotational cleat, and wherein the center point of the first medial rotational cleat and the center point of the second medial rotational cleat are both positioned on the medial side of the sole structure in different positions from one another.

11. The article of footwear according to claim 10, wherein each of the stud elements of the first medial rotational cleat is equidistant from the center point of the first medial rotational cleat; and wherein each of the stud elements of the second medial rotational cleat is equidistant from the center point of the second medial rotational cleat.

12. The article of footwear according to claim 10, wherein the plurality of stud elements of each respective medial rotational cleat are disposed such that the plurality of stud elements and the raised ring together form a closed circular shape.

13. The article of footwear according to claim 1, wherein the second medial rotational cleat includes at least two stud elements aligned in a longitudinal direction with the at least two stud elements associated with the first medial rotational cleat disposed along the outside medial side.

14. The article of footwear according to claim 12, wherein a rearwardmost stud element of the first medial rotational cleat is closer to the rearward edge than any other stud element of the plurality of stud elements of the first medial rotational cleat and wherein a forwardmost stud element of the second medial rotational cleat is closer to the forward edge than any other stud elements of the plurality of stud elements of the second medial rotational cleat, the rearwardmost stud element of the first medial rotational cleat is closer to the forward edge than the forwardmost stud element of the second medial rotational cleat.

15. The article of footwear according to claim 10, wherein the first group of traction elements have a generally curved airfoil shape and the first medial rotational cleat is spaced apart from the second medial rotational cleat.

16. The article of footwear according to claim 15, wherein the generally curved airfoil shape includes a wide end facing towards a heel region of the sole structure and a narrow end facing towards a forefoot region of the sole structure.

17. The article of footwear according to claim 10, wherein the plurality of stud elements associated with each medial rotational cleat have a generally curved airfoil shape.

18. The article of footwear according to claim 17, wherein the generally curved airfoil shape includes a wide end tapering to a narrow end in a clockwise direction.

19. A traction element arrangement for a sole structure of an article of footwear, the traction element arrangement comprising:

a plate on a bottom surface of the sole structure, wherein the plate extends across a substantial majority of the bottom surface and includes a longitudinal axis extending through a center of the plate and divides the plate into a medial side and a lateral side;

at least a first medial rotational traction element and a second medial rotational traction element integrally molded with the plate, wherein both the first medial rotational traction element and the second rotational traction element are disposed substantially on the medial side and wherein the first medial rotational traction element is spaced entirely apart from the second medial rotational traction element, the first medial rotational traction element and the second medial rotational traction element each comprising;

a raised ring extending out from the bottom surface a first height and a plurality of stud elements disposed on the raised ring and extending out from the bottom surface a second height, the second height being substantially larger than the first height, wherein each of the stud elements includes:

a curved inner face oriented towards and curved towards an inside portion of the respective medial rotational cleat, the curved inner face being concave; and a curved outer face on a radially opposite side of the stud element from the inner face, and wherein the curved outer face is convex; and wherein the raised ring of each respective medial rotational traction element is disposed between at least two or more of the plurality of stud elements;

wherein the raised ring and the plurality of stud elements of the first medial rotational traction element are arranged in an approximately circular grouping positioned radially around a center point in a forefoot region on a medial side of the bottom surface;

wherein the raised ring and the plurality of stud elements of the second medial rotational traction element are arranged in an approximately circular grouping positioned radially around a center point in a forefoot region on a medial side of the bottom surface, the center point of the second medial rotational traction element being spaced apart from the center point of the first medial rotational traction element;

wherein the bottom surface includes a central portion disposed radially inward of the raised ring;

wherein the plate is exposed at the central portion; and wherein the first height of the raised ring is higher than the central portion.

20. The traction element arrangement according to claim 19, wherein the plurality of stud elements of the first medial rotational cleat are disposed in a circular grouping spaced apart by approximately 120 degrees and the first medial rotational cleat is spaced apart from the second medial rotational cleat.

21. The traction element arrangement according to claim 19, wherein the plurality of stud elements are disposed in a semi-circular grouping spaced apart by approximately 90 degrees.

22. The traction element arrangement according to claim 21, wherein at least two of the plurality of stud elements are not connected by the raised ring to form an opening.

23. The traction element arrangement according to claim 22, wherein the opening is aligned in an approximately lateral direction to face the medial side.

24. The traction element arrangement according to claim 23, wherein the second medial rotational traction element includes a second opening; and wherein the second opening is aligned at an offset angle with respect to the lateral direction.

25. The traction element arrangement according to claim 19, wherein each of the of stud elements of the first medial rotational cleat is equidistant from the center point of the first medial rotational cleat; and wherein each of the stud elements of the second medial rotational cleat is equidistant from the center point of the second medial rotational cleat.

26. The article of footwear according to claim 10, wherein each of the stud elements of the first medial rotational cleat is equidistant from the center point of the first medial rotational cleat; and wherein each of the plurality of stud elements of the second medial rotational cleat is equidistant from the center point of the second medial rotational cleat.

* * * * *